US005115625A

United States Patent [19]

Barbulesco et al.

[11] Patent Number: 5,115,625

[45] Date of Patent: May 26, 1992

[54] IN-LINE BOTTOM LOADING CASE PACKER

[75] Inventors: Noel K. Barbulesco, Sonoma; Stan K. Lundquist, Denwood, both of Calif.

[73] Assignee: Sabel Engineering Corporation, Sonoma, Calif.

[21] Appl. No.: 648,825

[22] Filed: Jan. 31, 1991

[51] Int. Cl.[5] ..... B65B 5/04; B65B 5/06; B65B 7/20

[52] U.S. Cl. ..... 53/467; 53/491; 53/242; 53/284; 53/377.2

[58] Field of Search ..... 53/564, 242, 376.7, 53/377.2, 382.1, 387.2, 458, 468, 491, 284, 467; 198/626.3, 699.1, 728, 819, 861.1

[56] References Cited

U.S. PATENT DOCUMENTS

| | | | |
|---|---|---|---|
| 3,350,836 | 11/1967 | Dillon et al. | 53/242 X |
| 3,373,665 | 3/1968 | Bivans | 53/564 X |
| 3,521,427 | 7/1970 | Masch | 53/242 X |
| 3,605,377 | 9/1971 | Sabel | 53/564 X |
| 3,753,333 | 8/1973 | Derderian et al. | 53/564 |
| 3,757,486 | 9/1973 | Feurston et al. | 53/242 X |
| 3,959,950 | 6/1976 | Fukuda | 53/377.2 X |
| 4,018,143 | 4/1977 | Dice, Jr. et al. | 53/564 X |
| 4,213,285 | 7/1980 | Mancini | 53/564 X |
| 4,570,421 | 2/1986 | Focke et al. | 53/377.2 X |

*Primary Examiner*—Horace M. Culver
*Attorney, Agent, or Firm*—Owen, Wickersham & Erickson

[57] ABSTRACT

A machine and a method for folding bottom flaps of a box after or in coordination with box loading where all of the activities take place along one axis. The arrangement of all elements along the axis provides improved accessibility to facilitate clearing and servicing the machine. Precise indexing moves the boxes with a smooth cycling transfer motion from station to station in the machine as product in the box is supported and the bottom flaps of the box are folded under the product.

The folding of the box's bottom minor trailing flap is accomplished by a three piece mechanism which supports the product in the box and closes this flap.

The in-line arrangement permits easy adjustment of the machine for different size boxes. Threaded rods which are connected by chains, chain sprockets, unit rate gear boxes, half rate gear boxes, and shafts which move relevant operating elements to easily adjust the machine's box guide dimensions.

25 Claims, 19 Drawing Sheets

IN-LINE BOTTOM LOADING CASE PACKER

FIELD OF THE INVENTION

This invention relates to packaging machines and more particularly, it relates to a machine for automatically loading articles into folding boxes, cartons, or cases.

BACKGROUND OF THE INVENTION

In the packaging industry various machines have been developed for which loading products into standard top opening boxes (cases or cartons) from the top while the bottom of the box is closed or horizontally from one side or one end or from the bottom while a side, end, or a bottom of the box is open. Such apparatus and methods are disclosed in prior U.S. patents, i.e. U.S. Pat. Nos. 3,605,377; 3,748,813; 4,397,599; 4,481,752; and 4,674,261 all of which are hereby incorporated herein by reference. Box loaders as disclosed in the prior art have several drawbacks. One problem with these prior art loaders which are designed to load a standard top opening case or regular slotted carton (RSC), is that in order for product loading and closure of the bottom flaps of the box to take place it is necessary to move the box in a crosswise or lateral direction requiring additional loader width and increased complexity on changeover. (An RSC has two opposing minor flaps and two opposing major flaps such that when the box is closed the minor flaps are folded and touch upon the product enclosed by the box and the major flaps overlap the minor flaps and meet to provide a relatively uniform surface along the top and bottom surfaces of the box when closed; other types of boxes have flaps that may be non-overlapping or may overlap partially of fully). In these loaders the bottom flaps are closed by moving the case being loaded generally horizontally in a first direction and then in a second direction perpendicular to the first direction, i.e. a lateral movement. The minor flaps (the inner flaps) are folded around a product loading elevator plate which has carried the product into the carton. The minor flaps are folded over the outside edges of the elevator plate capturing both the product and the elevator plate. Then the case (now containing the product) is slid off the elevator plate folding the bottom leading major flap to a second position onto an adjacent support platform where the already folded minor flaps and folded major flap are between the product and the platform. After reaching this second position, the case is moved in a second, lateral, direction perpendicular to the direction of the first motion. When moving in this second direction the major flaps are folded to their closed position by flap folding rods to their closed position and the box is sealed closed by tape or glue.

When tape is used as the closure means, pressure sensitive tape is applied to seal the box after the major flaps are fully closed.

When glue is used as the closure means, hot melt glue is applied to the inner (minor) flaps of the box as the major flaps are simultaneously being folded to their closed position. Once the box has made it through the flap folding rods it reaches a compression position (station) where the top and bottom of the box are pressed closed to hold the major flaps in a closed position for a short time (i.e. 1–5 secs.) to allow the fast setting glue to set holding the major flaps closed.

Another disadvantage of this type of loader is that a box size change is a very complex procedure. The two directions of motion require that two axes of the loader be adjusted and that corner components connecting to both the product loading station and the major flap folding station be non-interferingly adjusted. Accommodation of both adjustments requires a complex mechanism or a large number of interchangeable (changeover) parts. Also, the coordination of box moving mechanisms within the loader is hampered by the wide variability of potential box sizes. There is no central coordination of the many motions of the machine, so as a result many pieces and speed controls have to be changed and modified and/or adjusted in order to accommodate different box sizes and variations in the speed of operation.

When the prior art loaders jam or require maintenance, access for clearing or servicing the loader is complicated by the two axes of motion and their perpendicular paths. Operational clearing might be necessary when a box jams in the loader or the product somehow fails to load properly. Access to loader components and boxes near the center of the machine for both operational and maintenance servicing, at an extreme distance from the access points at the edge of the machines, is difficult.

Speed adjustment of the prior art machines loaders requires adjustment of each operating motion in consecutive order. Nearly all the motions in the prior art machines are powered and controlled primarily by hydraulic and pneumatic systems using hydraulic and pneumatic rams. Speeding up these machines requires that the amount of fluid flowing to each operating element (ram) be checked and/or revised and that these motions be coordinated with operating loads in place. Each ram must be adjusted independently to avoid interference between boxes moving to the direction changing corner of the machine and boxes moving from that corner to the discharge station of the machine. Therefore during operation, any change in speed would have to have been done iteratively and gradually. Or absent actual operation, changes in speed would have to have been evaluated using a simulated load in order to properly gauge the time vs. load response of the hydraulic and/or pneumatic devices.

These disadvantages in prior art bottom flap folding machines discourage changing sizes, unnecessarily complicate operational clearing and maintenance, and make increasing the speed a complex multi-stepped effort.

SUMMARY OF THE INVENTION

The present invention provides an in-line bottom flap folding box loading machine including improvements which eliminate or reduce the disadvantages of the prior art loaders/machines discussed above.

An in-line box loading structure according to this invention includes, but is not limited to, the following improvements over the prior art. A structure according to the invention is capable of running higher speed and can adjust the throughput speed more easily than the prior art, provides enhanced greatly simplified size change flexibility, provides better accessibility to the structure for clearing operational jams and better access for maintenance, provides precision mechanical indexing between operational stations, and provides for folding of the box bottom flaps after the box has been loaded, all, in a structure where the box to be folded is moved only along one axis (in-line).

The present invention includes a structure and a method where a box with its bottom flaps in an open position is loaded with a product at a loading position along a longitudinal axis of a frame of the structure and then the bottom flaps of the box are moved to a closed position as the box is moved generally along the axis to a discharge position, i.e. the box is moved in-line without lateral movement.

The invention holds a box at a first operational position in the frame with its bottom flaps open. A product is loaded into the box while the bottom flaps are open. Then, as the box is moved to a second (adjacent) operational position by a transfer means, its bottom leading minor flap is closed. At this second (bottom back flap folding) position, several coordinated elements support the product in the box while causing the bottom trailing minor flap of the box to be moved to its closed position. The box is then moved by the transfer means further along the frame axis. As the box is moved further along the axis both its major bottom flaps are moved to their closed positions by a set of major flap folding rods positioned alongside the path of the box.

Coordination and sequencing of operational activities at each of the operational positions is controlled by and from a central programmable controller. This controller transmits signals initiating each operational activity and receives sensor signals indicating that the initiated activity or other activities sequentially following it are complete, all the while monitoring related operational activities for malfunctions. One of the operational activities is the initiating of transfer means for an indexing cycle (moving the box being loaded from one station in the machine to its next station). Indexing is accomplished by energizing a drive motor driving an index drive which accelerates the box gradually from its stationary position at one station to a high speed between stations and then gradually decelerates the box to a stop at its next station. The drive motor speed can be adjusted by an operator to increase or decrease the speed of indexing and thereby easily change the throughput speed of the machine up to a predetermined maximum. This provides greatly simplified speed adjustment, when compared to the prior art.

The invention has a bottom score line plane (a bottom reference plane) coinciding with the bottom score line of the boxes being processed. It also has a drive side reference plane, perpendicular to the bottom score line plane which includes a fixed drive side guide rail against which all boxes moving in a structure according to the invention slide. All boxes in the structure move along and are in constant contact with these two reference planes. A movable side rail assembly is located across the bottom score line plane, parallel, and opposed to the fixed drive side guide rail. The movable side rail assembly can be moved for a width adjustment. The distance between the fixed drive side guide rail and the movable side rail sets the width of the boxes being processed.

The movable side rail assembly is rotatably mounted to a movable side rail support assembly which has one or more stop assemblies which prevent the movable side rail assembly from rotating and hold the movable side rail assembly in its operational position, i.e. fixed opposite the fixed drive side guide rail. When access is required to the path of the box in a machine according to the invention (to clear an operational jam or provide maintenance), the stop assembly is released to permit the movable side rail assembly to pivot around its mounting away from its stop out of the access path.

When a width adjustment in a machine according to the invention is desired, the structural and operational members interacting with the outside of the width of the boxes being processed must be moved to correspond to a new width dimension. These movements and members are known respectively as full (box) width adjustments and full width adjustment members. Width adjustments must also move structural and operational members interacting with or requiring a fixed relationship to a longitudinal centerline of the boxes being processed must be moved to correspond to a new centerline of the new width of boxes being processed. These movements and members are known respectively as half (box) width adjustments and half width adjustment members. Some other structural and/or operational members do not require a particular relationship to the outside of the width of the box or the box centerline, but can perform their function for all box sizes within a particular machine's predetermined box size range when each one is specially configured according its support which can be fixed, or can move with either the full width adjustment members, or the half width adjustment members. These members are known as full width range members.

The movable side rail support assembly is a full width adjustment member. The movable side rail support assembly supports and moves all full width adjustment members. The movable side rail support assembly is threadably connected to full width adjustment threaded rods, such that when these rods are turned the movable side rail support assembly moves to change the width dimension of the machine available to accommodate a new box width. Each full width adjustment threaded rod is fixed to a width adjustment sprocket. The sprockets are inter-connected such that turning one sprocket and full width adjustment thread rod simultaneously turns the other width adjustment sprocket(s) and full width adjustment threaded rod(s).

A movable centerline support assembly is a half width adjustment member and supports all half width adjustment members. The movable centerline support assembly is threadably connected to one or more half-width (centerline) adjustment threaded rods, such that when these rods are turned the centerline support assembly moves to change the location of the half width adjustment members to coincide with the centerline of the box path. The half-width adjustment threaded rods (which are parallel to the width adjustment threaded rods) are each connected by a right angle gear box to a half-width threaded rod connecting shaft which when turned causes the connected half width adjustment threaded rods to turn simultaneously. A 2:1 right angle reducing gear box connects one full width adjustment threaded rod with the half-width threaded rod connecting shaft, so that the half-width adjustment threaded rods turn at half the rate of the full-width adjustment threaded rods whenever the full-width adjustment threaded rods are turned.

A box depth adjustment is also provided. When it is desired to close box top flaps in addition to bottom flaps, a mechanism according to the invention can be adjusted and is positioned to be referenced to a top flap score line of the box being processed, so that the top flaps of a box moving through the machine are closed as the box moves through a machine according to the invention.

When box top flap closing structural and operational members are provided, the movable centerline support assembly supports and includes a depth adjusting assembly. A half-width adjustment threaded rod, connected to the half-width threaded rod connecting shaft, as previously discussed, moves a top half width adjustment support structure (according to the previous description for the centerline support assembly) when the rod is turned. A top half width adjustment support member is connected to the top half width adjustment support structure by one or more depth adjustment threaded rods. The depth adjustment threaded rods are connected to turn simultaneously by chains and sprockets, similar to that previously described for the full width adjustment threaded rods, to provide depth adjustments by turning one depth adjustment threaded rod, thereby greatly simplifying depth adjustments.

Transfer means is provided by flites attached to a first continuous flexible support structure (preferably a roller chain) oriented along the longitudinal axis of a machine routed around sprockets on two shafts according to the invention to move boxes from station to station. Flites are equally spaced along the first continuous flexible support structure (chain). In a machine according to the invention, when a box is opened and loaded at a first station of the machine, such that the product keeps the box from collapsing while it is indexed forward, only a push flite is provided. When only a push flite is provided there is no length adjustment as the distance between flites is pre-set and not adjustable.

However, in another machine according to the invention when a first operational station is used to open the box from its flat (as shipped from the box manufacture) configuration and product loading takes place at a second operational station, there is danger of the box collapsing back to its flat configuration unless leading flites are provided. Leading flites are supported from a second continuous flexible support (i.e. a roller chain) which is parallel to the first flexible support (chain). The leading flites spacing is identical to the push flite spacing, however the leading flites are offset by a distance equal to the length of the box, forward of the push flites. Thereby assuring that the empty open box does not collapse as it moves from the first operational station to the second operational station.

Both the first and second continuous flexible flite supports encircle a pair of shafts such that during operation the shafts turn and the supports move simultaneously forward. One of these shafts is a drive shaft. The length adjustment between leading and push flites is made by releasing a clutch fixing the second continuous flexible support (chain) to the drive shaft, allowing the second support (chain) to move freely around the drive shaft and relative to the first continuous flexible support (chain) while the first support remains fixed. The second support is then adjusted to provide the predetermined new box's length between a push flite and its corresponding leading flite. The second support is then locked to the drive shaft and the length adjustment is complete.

The features of a structure according to the invention which are preferably mounted along the bottom centerline of the box as it is being closed are: a support tongue, a main slide plate (supporting the box at the center of the bottom score line plane throughout the frame at locations other than the bottom back folder and the loading position), a bottom glue head, a bottom compression unit (for a glue sealing machine), or a bottom tape head (for a taping sealing machine); and along the top centerline of the box are: a trailing minor flap kicker, a leading minor flap plow, a set of major flap folding rods, a glue head, a top compression unit, or a top tape head.

The invention includes a depth adjustment means which supports all of the members which must be adjusted for depth adjustment of a box. The depth adjustment means includes all of the components listed as being mounted along the top centerline, above.

A device according to this invention can accommodate various sizes of boxes having bottom flaps of varying lengths. Boxes having non-meeting, meeting, partially overlapping and fully overlapping bottom flaps can be closed. If overlapping (partial or full) flaps are to be used then a structure according to the invention will provide that one major flap is folded before (one or more stations preceding) the second major flap is folded, so that the overlapping flaps do not interfere with one another as they are being folded.

There are several stations along the axis of a frame according to the invention. At each station an activity takes place while the box remains at a standstill. At a first station, box opening and/or box loading can take place At a second station box bottom trailing minor flap closing or product loading can take place. At a third station bottom trailing minor flap folding and/or top minor flap (leading and trailing) folding or major flap folding can take place. At subsequent stations and/or positions the as yet uncompleted steps are performed, i.e. major flap folding, gluing, compression (glue setting), and/or taping.

The invention provides the flexibility to vary operating speed easily from a central location and to choose which operations will be performed at the various consecutive stations within operating constraints. Some operations have the option of being performed simultaneously or in consecutive order at one station, but other operations must be performed at consecutive stations so that they do not interfere one with the other. For example, box opening, holding, and loading can take place at one station. While minor flap (top or bottom) folding may take place only after the product has been loaded and prior to the closing of the major flaps (top or bottom), otherwise the operations would interfere with each other. Further, if glue is to be used as the sealing means, then the glue must be applied on portions of the minor flaps before the major flaps are folded to a fully closed position. Similarly, before pressure sensitive tape can be applied to the outside of the box, the bottom and/or top major flaps must be in a fully closed position so that there is no gap between the flaps when the tape is applied.

The precise repeatable positioning (indexing) of each box and its push flites at each consecutive operational station is accomplished by coordination between the central system controller and specially chosen drive components, which provide for error free precise positioning. The drive shaft driving the flexible support flite drive is connected to a set of rotary cam limit switches so that the switch unit makes one revolution per indexing cycle. One of the set of limit switches senses a full revolution of the set of rotary cam limit switches thereby notifying the central controller to shut down the drive motor until the next indexing operation. Due to wear, incorrect adjustment, and changing environmental factors the position at which the drive shaft actually stops after a switch opening could vary by several degrees, if the position switch alone were relied on to stop the drive shaft. An Index (or Cam) Drive is utilized with a dwell (static output with continuous input) in its input-to-output relationship which overlaps the expected stopping point of the drive shaft, so that the output shaft of the Index Drive (driving the drive shaft) has already mechanically stopped before the drive motor is shut down. A slightly erroneous electrical shutdown of the drive motor before or after the expected stopping point will not affect the actually drive shaft stopping position until the erroneous advance or delay is substantial.

Bottom flap folding according to the invention is as follows. A box with open bottom flaps is positioned over a product elevator. An elevator plate of the elevator carrying product positions the product in the box.

The box is then indexed (moved) in a forward direction by means for transferring (i.e. mechanical flites mounted on and extending from a roller chain) to a second station (position). During the movement of the box to the second station a "curved plate after loading", having a front edge which is positioned below the bottom score line plane of the machine, deflects the bottom leading minor flap of the box to its closed position as the box moves across the "curved plate after loading." Similarly, as the box is indexed across the product loading elevator its bottom trailing minor flap is deflected up into a horizontal (180° from closed) position as it moves across the elevator platform and "curved plate after loading".

At the second position, adjacent the product elevator, the box is supported at a forward end by two fixed supports each of which is located near the leading side edges of the box leaving space between the supports for a support tongue in its retracted position. The support tongue and a folding platform, both in their extended positions support the bottom trailing end of the box. A folding platform extends beyond the trailing side of the box to a point adjacent to a forward edge of the "curved plate after loading" and supports the bottom trailing minor flap in its horizontal position trailing the box. The folding platform then drops to release the bottom trailing minor flap from its horizontal position allowing the bottom trailing minor flap to drop. The support tongue still extended supports the trailing end of the box. Once the folding platform has moved out of a closing path of the bottom trailing minor flap, a bottom back folder, which is initially positioned out of the way under the "curved plate after loading", is retracted causing the bottom trailing minor flap to move through its closing path to its closed position. Once the bottom back folder has fully retracted, the folding platform and the support tongue, which is of a relatively thin cross-section, are simultaneously extended and retracted, respectively. During the extension of the folding platform and simultaneous retraction of the support tongue, the trailing end of the box is temporarily primarily supported by a top end of the bottom back folder and secondarily supported by the support tongue while it is being retracted. These components support the trailing end of the box until the folding platform rises sufficiently to come in contact with the trailing end of the box to support the box with the bottom trailing minor flap in its fully closed position.

The folding platform when it is fully extended (i.e. elevated) has its top surface is in approximate alignment with the bottom score line plane of a structure according to the invention. The fully retracted support tongue is at a position slightly below the top of the two fixed supports at the side edges of the forward end of the box, such that, when the box is indexed forward to the next station, a leading edge of the bottom trailing minor flap (now closed) does not interfere or get caught on the support tongue, but is urged away from it by beveled front corners of the fixed supports. Once these activities at the bottom trailing minor flap folding station (second station) are completed, a signal is provided to (or within) the controller which indicates that these activities are completed and thereby signaling that the box at this station is ready to be moved to the next station.

When the sensors at each of the stations indicate to the main controller that all station activities are complete the controller activates the drive unit causing the flites to move forward a predetermined amount thereby pushing the boxes to their next station.

At the station following the bottom trailing minor flap folding station the major flap folding and/or sealing of the box by glue or pressure sensitive tape can take place.

Because of the in-line movement of the boxes they are indexed precisely at each position providing reliability and a high level of confidence that the activity designated for that station will take place.

BRIEF DESCRIPTION OF THE DRAWINGS

(FIG. 5A shows the initial flap position, while FIGS. 5B–5E show progressive steps and positions of the flap and operational members as the flap is folded);

DETAILED DESCRIPTION

Figure 1:
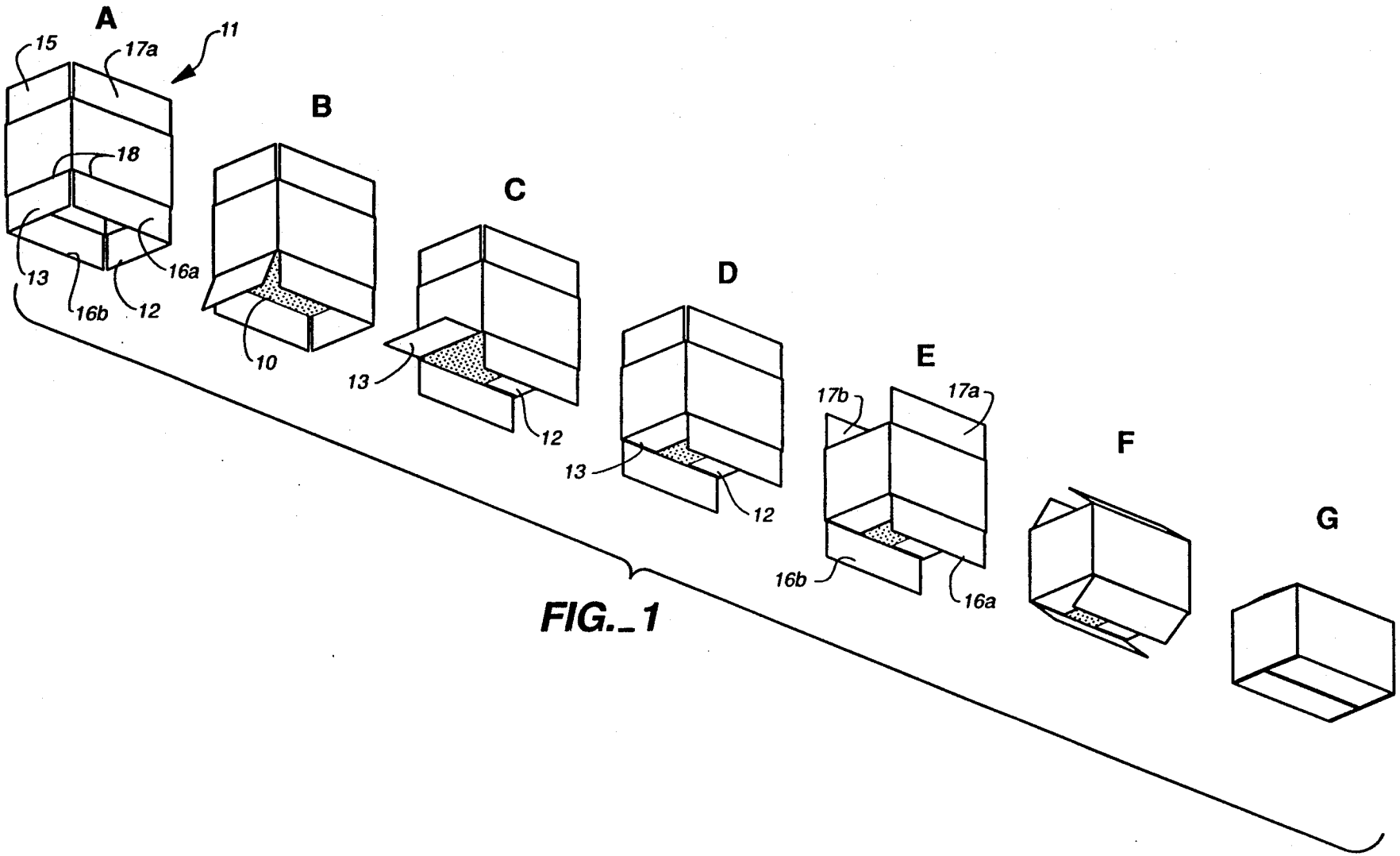
FIGS. 1A–1G show a carton and its flap closures as it moves through various stages of an embodiment of the invention.
Figure 2:
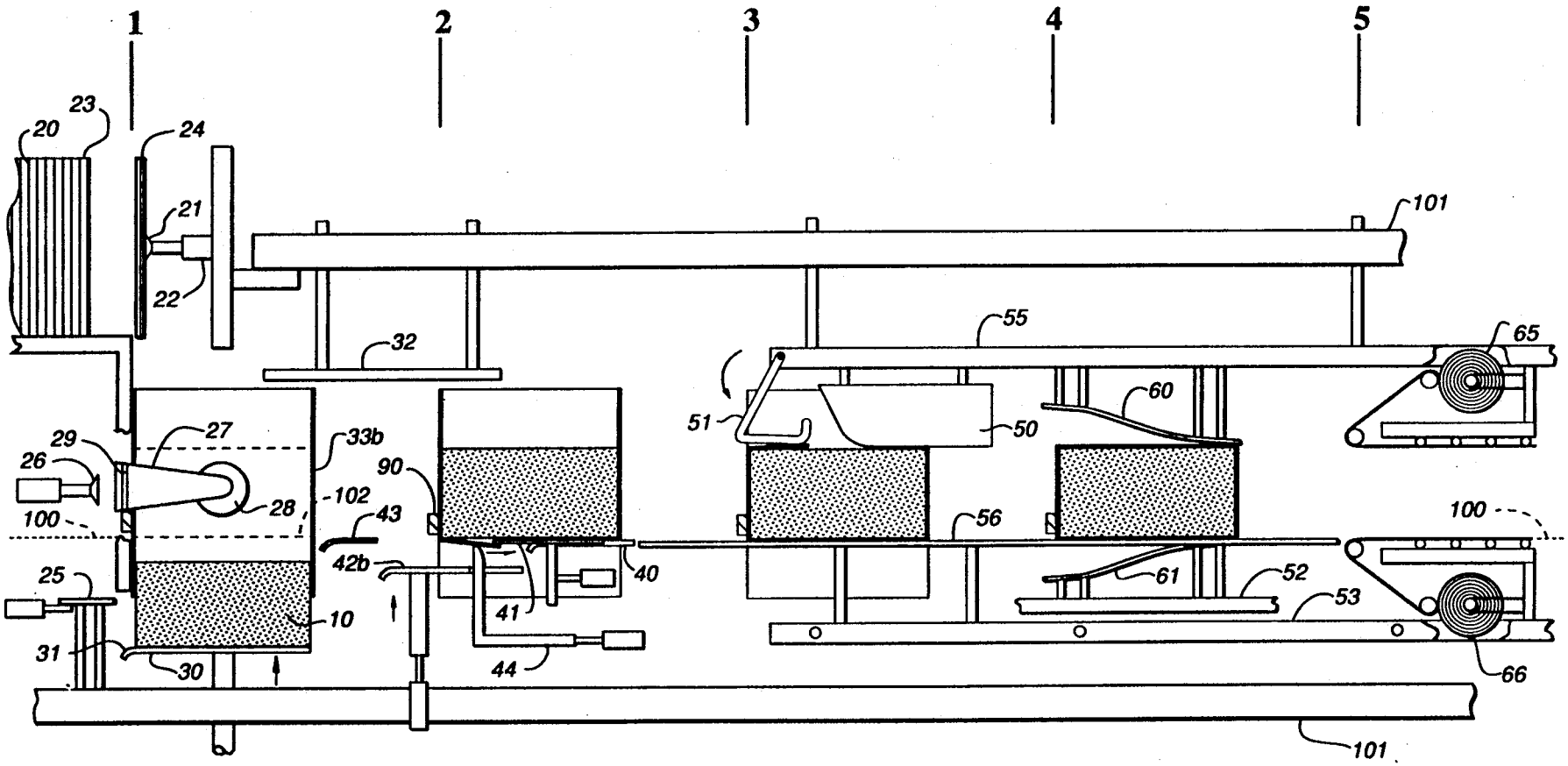
FIG. 2 shows a side view of an embodiment of the invention.

FIG. 2 shows an embodiment of the invention, while FIG. 1 shows a corresponding perspective view of a box as it progresses through the various stages of the embodiment of FIG. 2. FIGS. 3A-3J are a close-up of some portions of the stationary and movable operational members of FIG. 2 A bottom score line plane 100 sets the bottom plane of the box level and the bottom of the product loaded into a box as the box is moved from station to station (i.e. stations 1-5, as illustrated by reference numbers across the top) by the in-line packing machine. Even though these stations (1-5) are tied together by a frame 101 and a transfer means (FIG. 6), the operations at each station are isolated and can be reviewed and discussed separately. Operational activities at all the stations are performed simultaneous during a station activity time, such that when the operational activities at all stations are completed, a box drive mechanism is actuated and each box is moved to the next station, during a box transfer time.

At the station 1 (FIG. 2), a case magazine 20 holds a plurality of flat as yet unopened boxes stacked horizontally for use by the in-line packer. When initiated by a programmable controller 70 (FIG. 7), a suction cup 21 is extended by a piston and rod assembly (ram) 22 to contact the outermost box in the case magazine 20. The suction cups 21 have a vacuum routed to them by a vacuum pump (not shown), and attach themselves by vacuum to the outermost case 23 and pull it using the piston rod assembly 22 to a drop position 24. At the drop position 24 the suction cups 23 release the case 23 and it is guided by guides to drop onto a case bottom edge stop 25. Because of its nearly horizontal design, the case magazine 20 will hold 20 minutes or more running time of cases and can be restocked while the machine is operating without interrupting the production flow. Simultaneously, the product 10 to be loaded is collated into the desired boxing configuration, which can be a simple single tier or multiple tiered layers. Layer cards can be inserted automatically if needed. The bottom edge stop 25 is adjusted vertically according to the flap width of each box so that when a bottom edge of the longest bottom box flap is resting on this drop stop 25 the bottom score line of the box 102 coincides with the bottom score line plane 100. Once the box 23 is resting on the drop stop 25, a set of rear suction cups 26 attach to a rear side of the case 13 holding it in place. A front vacuum cup 28 is attached to a pivot arm 27 which is pivoted about a pivot axis 29 to come into contact with a front side of the dropped box **23*b*. The front suction cup 28 attaches to the front surface of the box. The arm 27 is then powered to pivot around pivot axis 29 until it reaches its lateral position, parallel to a longitudinal axis of the machine (as shown in FIG. 2). The front and rear opposing vacuum cups 28, 26 provide positive opening and are forgiving when opening out of spec cases. The case 23*b* is now erect and square. The case bottom edge stop 25, which had been extended to catch the case descending from the drop position 24, is now retracted to clear a path for loading the product 10 into the case. The box 23*b* is opened and has a configuration as shown in FIG 1A. The opened box is loaded by a product loading elevator 30 which gently loads the collated product 10 into the bottom of the case 23*b*. The elevator 30 has a bottom trailing flap kicker 31 such that when the elevator 30 is fully raised the bottom trailing flap kicker 31 causes the bottom trailing minor flap of the loaded box to be folded outward (FIG. 1B). The front (arm mounted) and rear vacuum cups 28, 26 holding the box 23*b* in position are now released as the product inside the box 23*b* will prevent the box from collapsing, thereby completing the operational activity at station 1. The case is then ready to move on to the next station, (i.e. station 2**).

When signaled transfer means, a push flite 90 (FIG. 6) suspended from a continuous flexible support (preferably a roller chain 91 stretched between two chain sprockets), is moved forward by turning a drive shaft 88. The drive shaft 88 is oriented so that the chain sprocket 92 engaging the continuous roller chain 91, turns a predetermined amount to move the box to the next station and then stops.

Figure 3C:
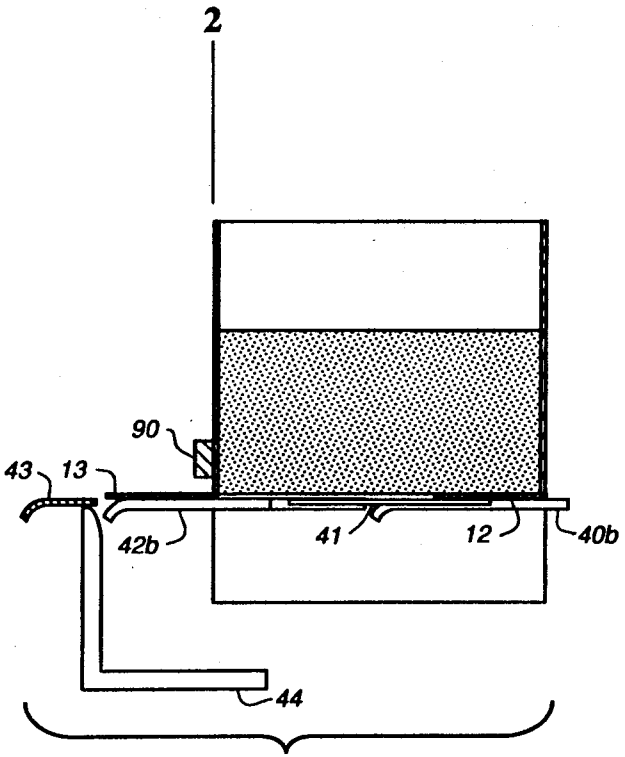
FIGS. 3A–3J show detailed (cross-sectional) side views of the progressive steps of an embodiment of FIG. 2 (the cross-sectional views are cut in various FIGS. 5)
Figure 5A:
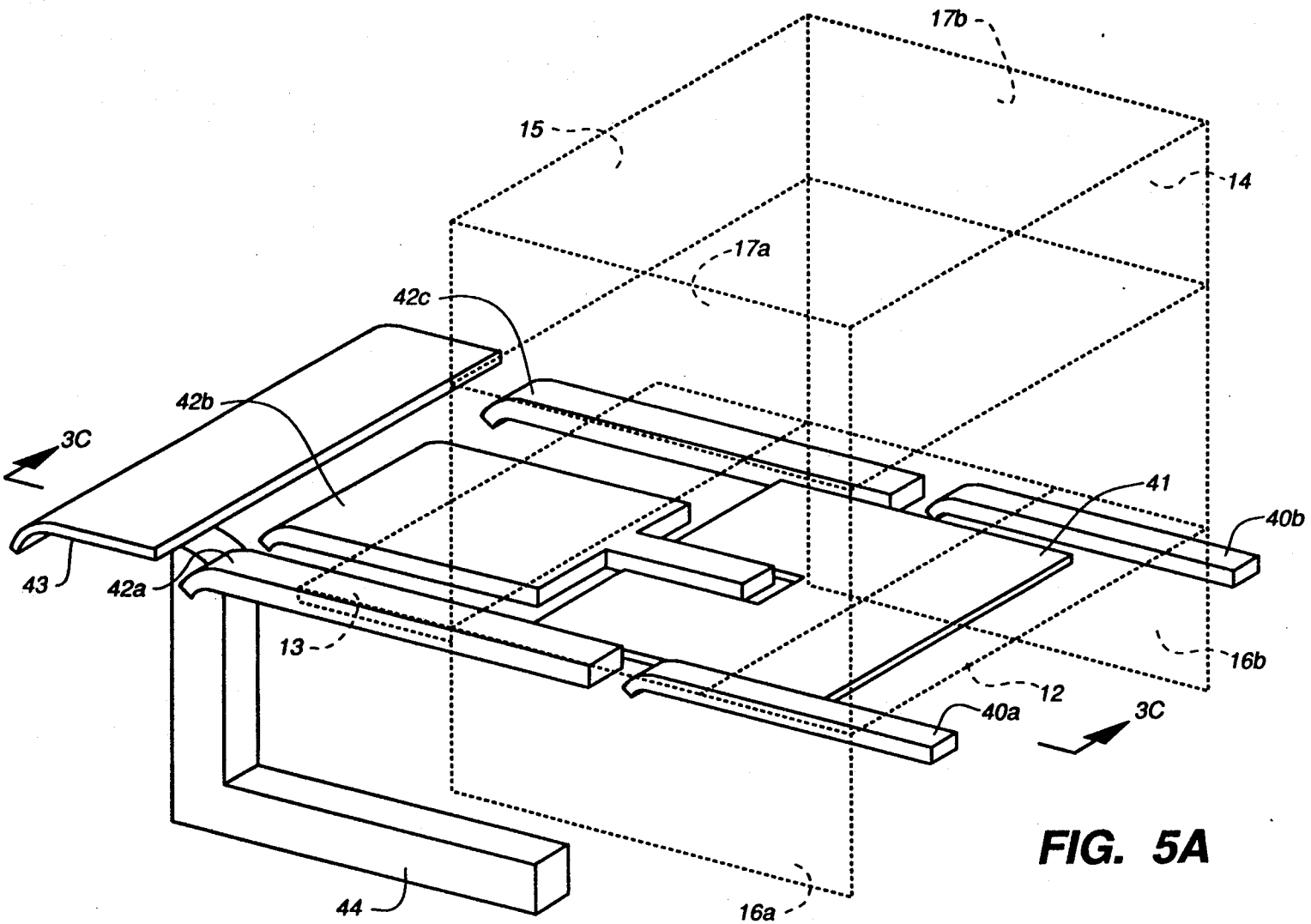
FIGS. 5A–5E provide perspective views of progressive steps of a bottom trailing minor flap being folded according to an embodiment of the invention.
Figure 5B:
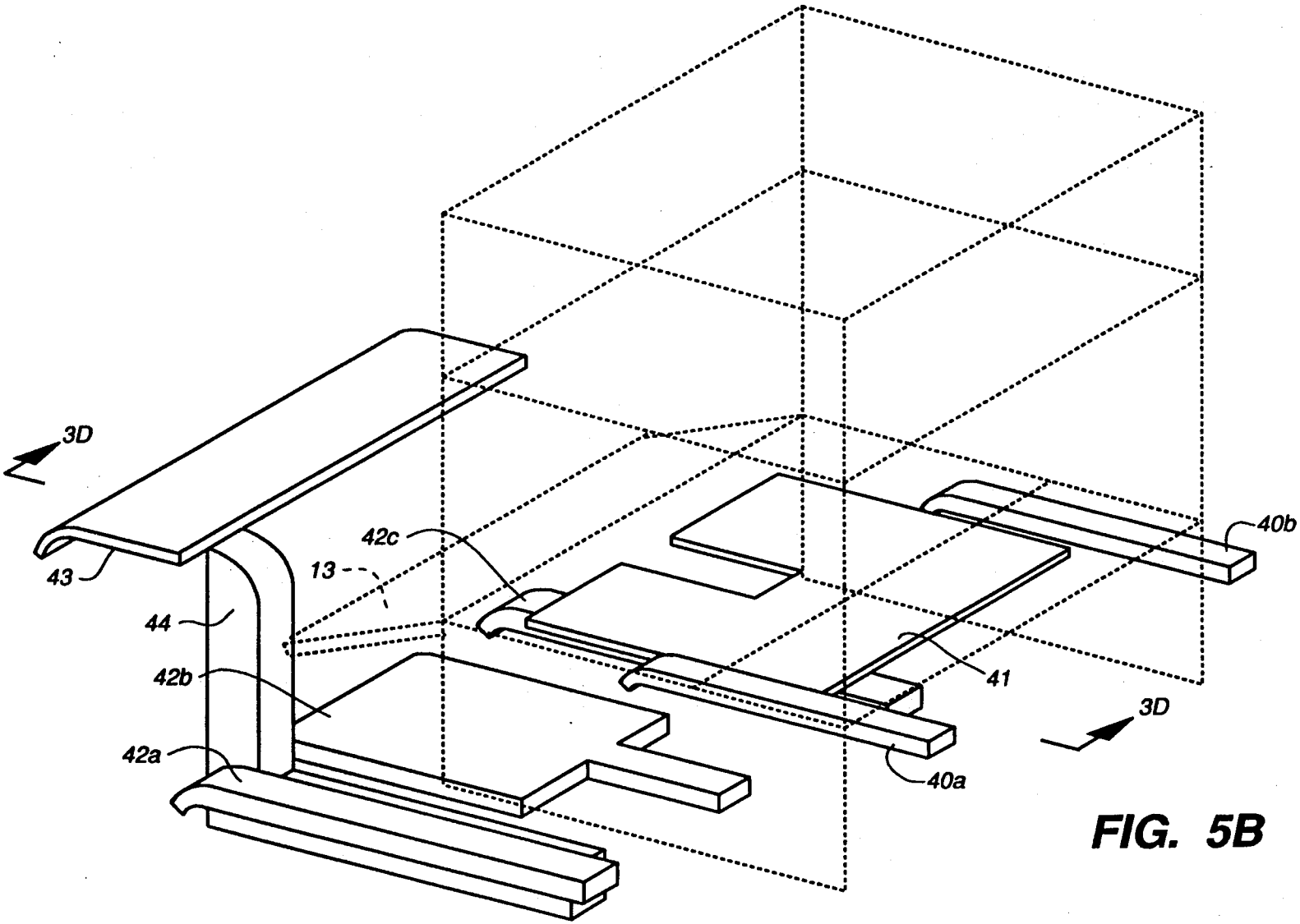
Figure 5C:
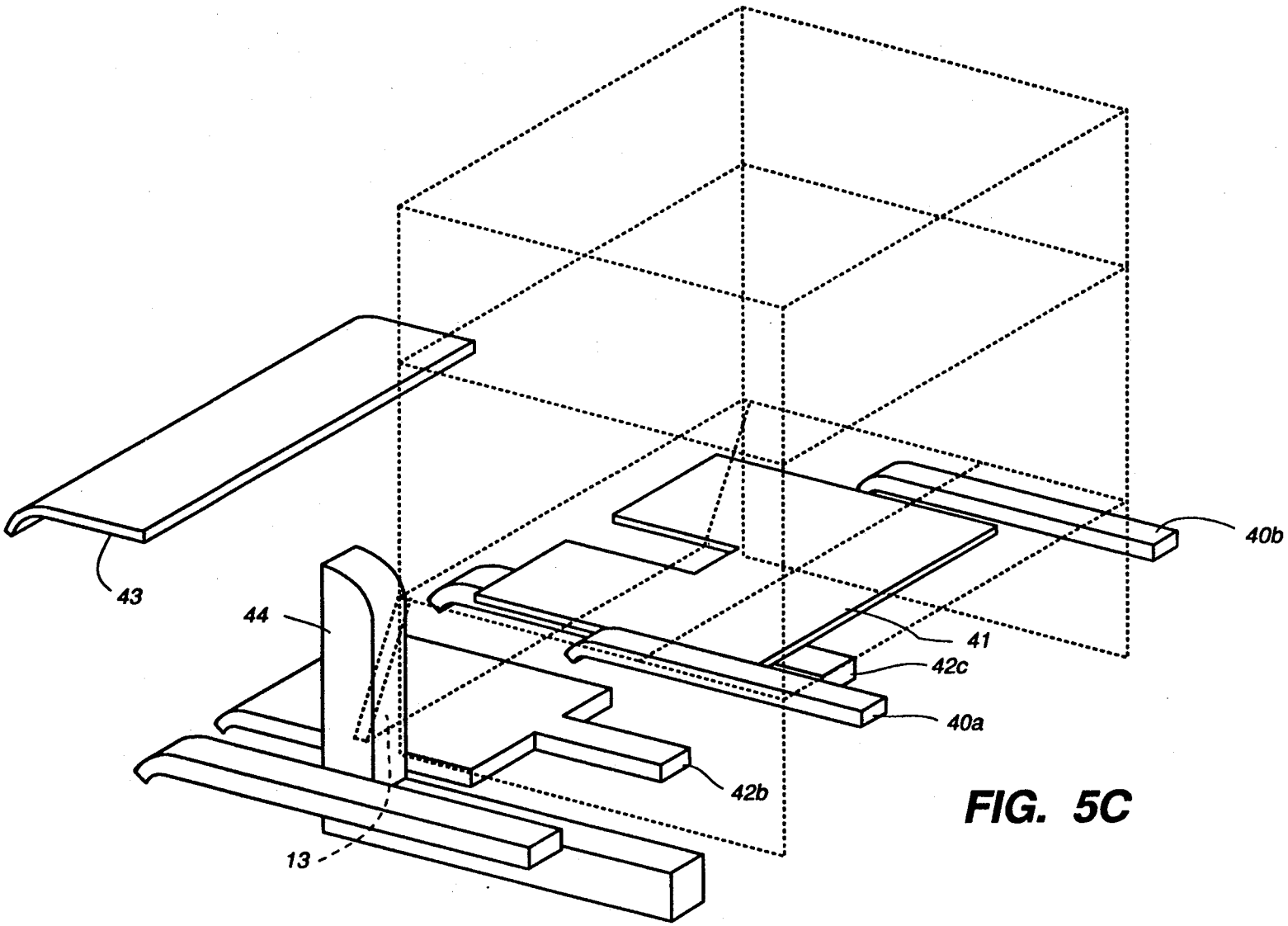
Figure 5D:
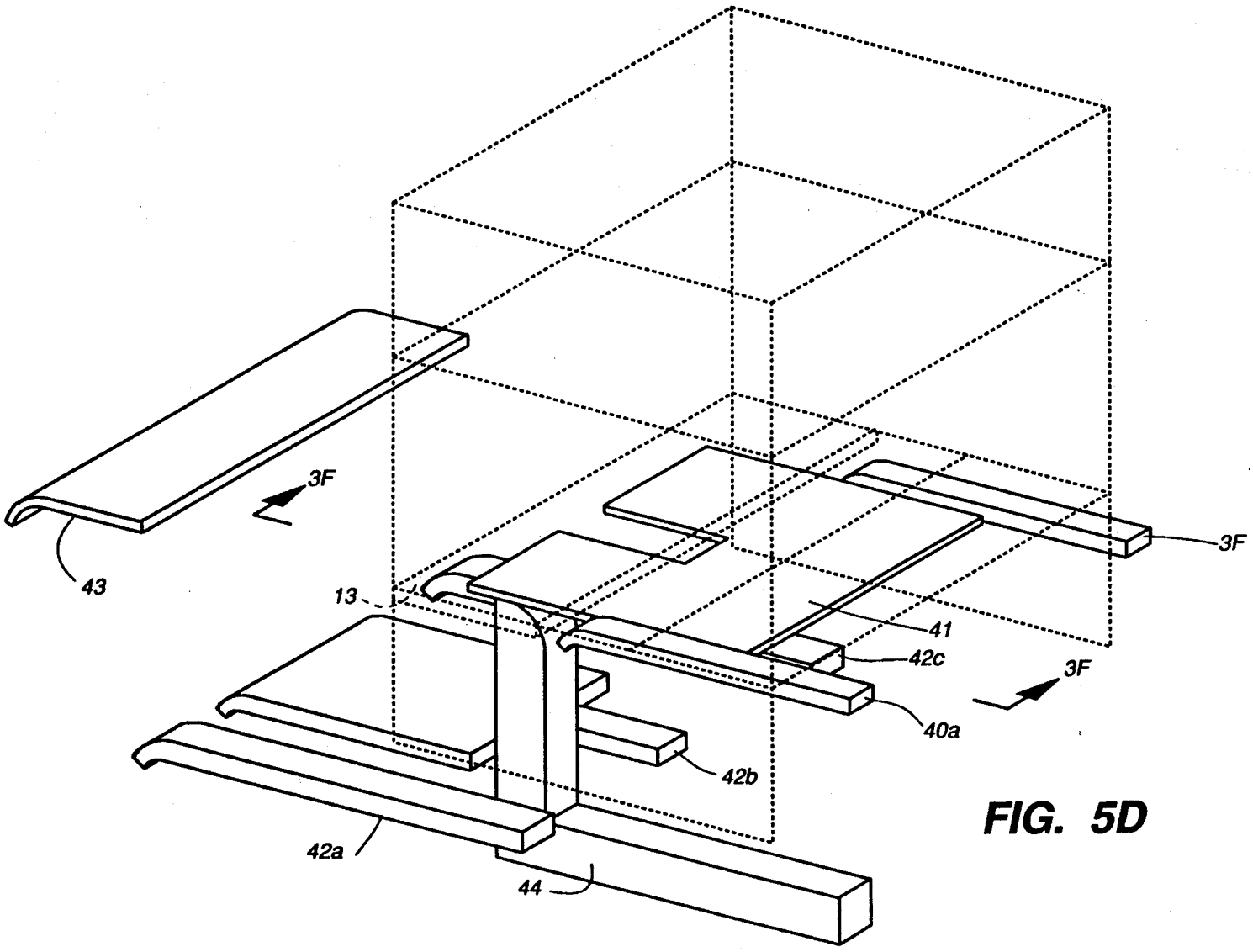
Figure 5E:
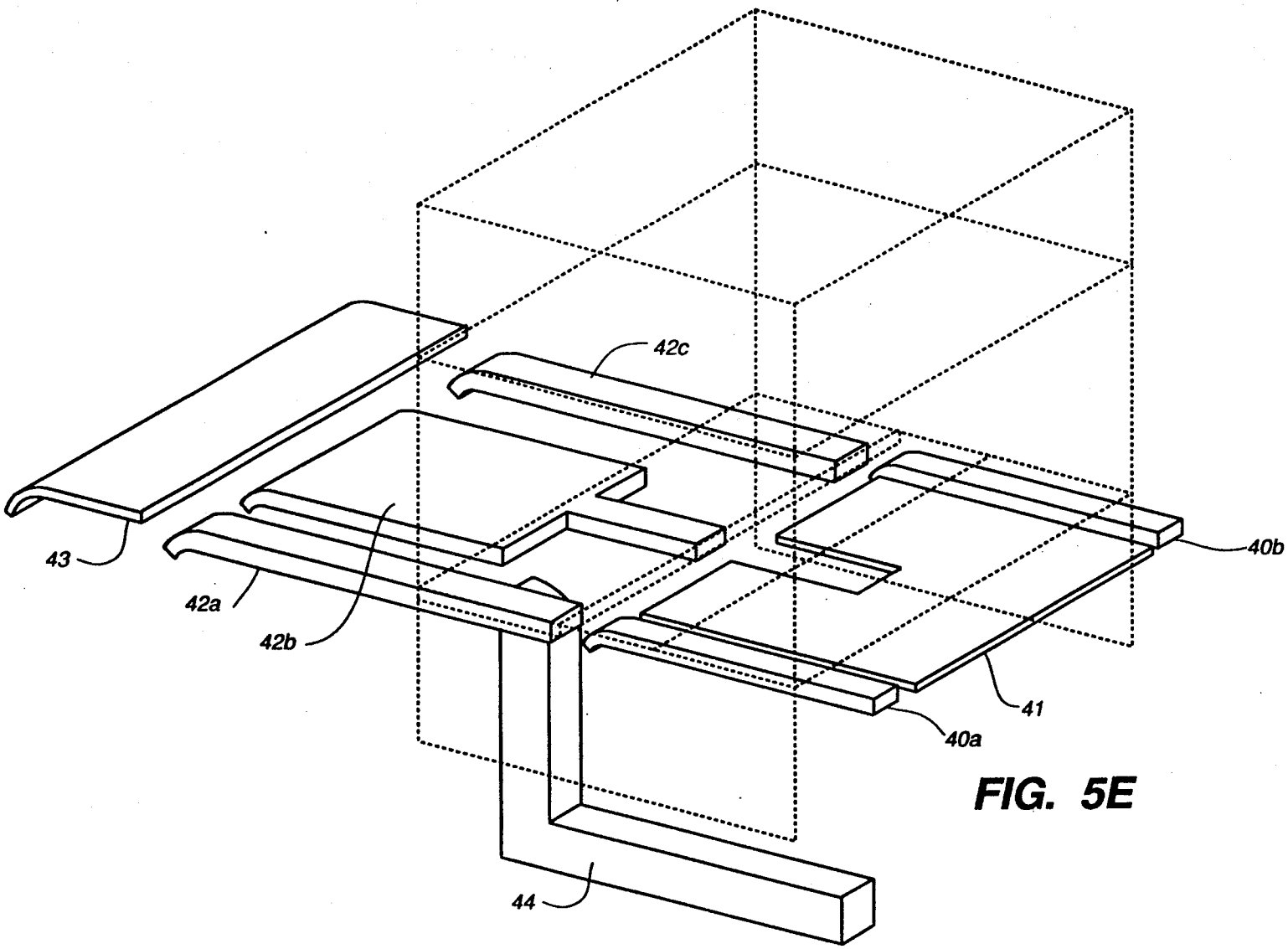

At station 2 (the bottom trailing flap folding station), a set of fixed supports **40*a*, 40*b*, a support tongue 41, and a folding platform 42*a,b,c* are operated to close the trailing bottom minor flap of the box. A "curved plate after loading" 43 is provided between station 1 and station 2 such that when the box 23*b* is moved from station 1 to station 2 the leading bottom minor flap 12 is folded into its closed position, as shown in FIG. 1C (the product loaded into the bottom of the carton is shown in cross-hatching). The trailing bottom minor flap 13 is in a position parallel to the bottom score line plane 100 of the machine. At the time the box arrives at station 2, the bottom back folder 44 is in an extended position, and the support tongue 41 is in an extended position. A close-up view of the members supporting the box at station 2 are shown in FIGS. 3C-3G and 5A-5E. Initially when the box is moved to station 2, the configuration of the members is as shown in FIGS. 3C and 5A; the leading bottom minor flap 12 is in a closed position, the support tongue 41 is in an extended position, the folding platform 42 (having sections 42*a*, 42*b*, and 42*c* which provide a planar surface along their collective top surfaces) is in an extended (up) position, and the bottom back folder 44 is in an extended position. The folding platform 42 is then retracted causing the trailing end of the box to be supported by the extended support tongue 31. As the support platform 42 is retracted the trailing bottom minor flap tends to move toward its original fully open (down) position due to the tendency of newly folded cardboard to unfold along the score line of the trailing bottom minor flap and gravity, as shown in FIGS. 3D and 5B. Once the folding platform 42 is out of a closing path of the trailing bottom minor flap, the bottom back folder 44 begins retracting. This retraction causes the trailing bottom minor flap 13 to be caught by a vertical leading edge of the bottom back folder 44, as shown in FIGS. 3E and 5C. As the bottom back folder 44 continues to retract the trailing bottom minor flap 13 is moved to its closed position overlapping the bottom of the support tongue 41, as shown in FIGS. 3F and 5D. Once the bottom back folder 44 has reached its completely retracted position the folding platform 42 (sections 42*a*, *b*, and *c*, which are fixedly tied together) begin extending and simultaneously the retraction of the support tongue 41 begins. The folding platform 42 then is extended (rises) fully to hold the trailing bottom minor flap 13 in its fully closed position, supporting the trailing end of the box while the support tongue 41 is fully retracted to a position between the fixed supports 40*a* and 40*b* such that when the box is transferred to station 3 the front edge of the trailing bottom minor flap 13 does not interfere with the rear edge of the support tongue 41 to jam the machine. To decrease the likelihood of jamming the machine in this way, the support tongue's 41, top surface, when it is in its retracted position, is approximately one quarter inch below the top surface of the adjacent fixed supports 40***a* and 40*b*. After the trailing bottom minor flap 13 is closed as shown in FIGS. 1D, 3G, and 5E, the box is moved by the transfer means to station 3.

In this embodiment (FIG. 2) of this invention the top minor flaps of the box, if any, are closed by a centrally aligned plow 50 which causes the top leading minor flap to move to its closed position as the box is indexed to the third station. Also, a top minor trailing flap kicker 51 is raised (FIG. 3H) (to be elevated above the top edge of the top minor trailing flap) as the box moves to the third station and drops to fold the trailing top minor flap 15 into its closed position. This is the only activity occurring during the station activity time at station 3. The box flaps after the operational activity at station 3 is completed are configured according to FIG. 1E and 3I.

From station 3 as shown in FIG. 2 the box is indexed forward to station 4. While the box is being moved between stations 3 and 4, major flap folding rods both top 60 and bottom 61 cause the major top and bottom flaps to close just before entry into a pressure sensitive tape applying section at station 5, where rolls of pressure sensitive tape 65, 66 are mounted on the top and the bottom of the box path along the centerline of the box to tape the box sealed closed. The tape is automatically cut and moves further on to subsequent activities.

Figure 3B:
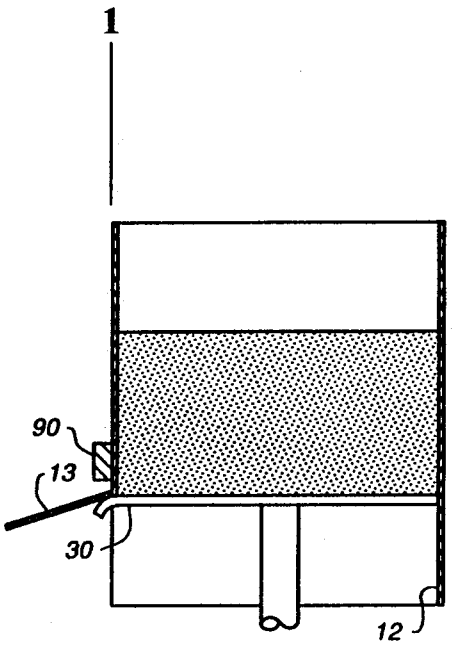
Figure 3A:
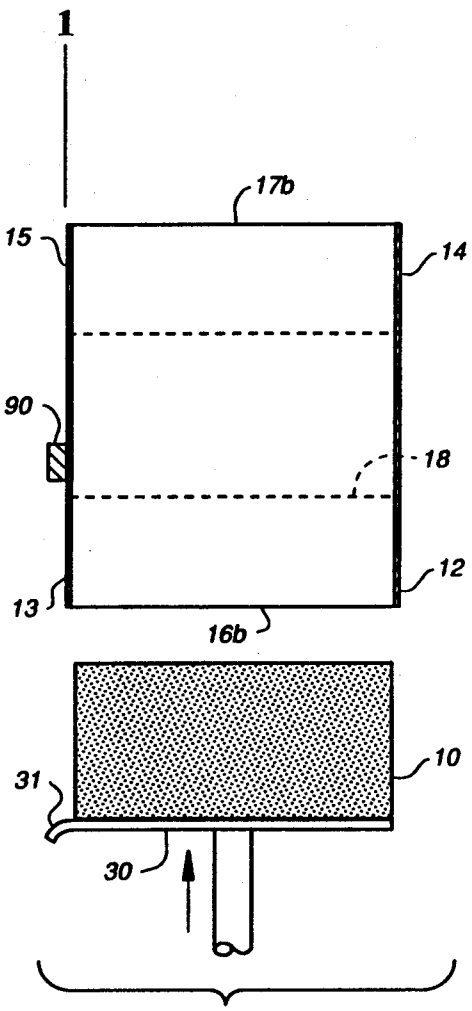
Figure 3F:
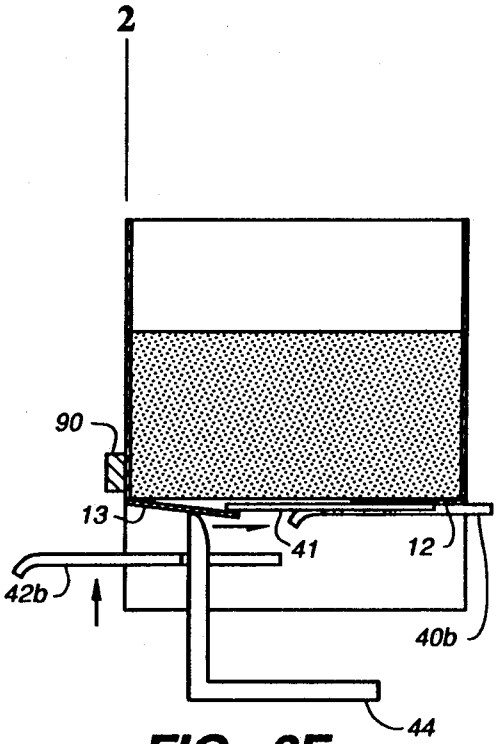
Figure 3E:
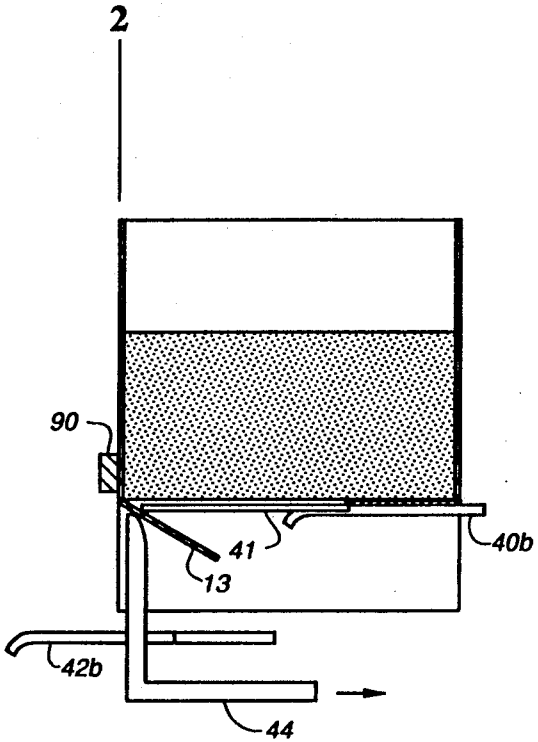
Figure 3D:
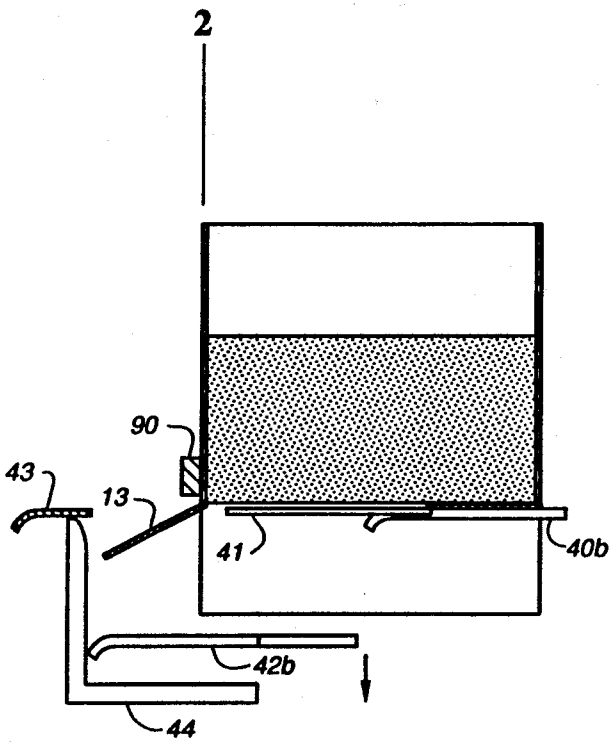
Figure 3H:
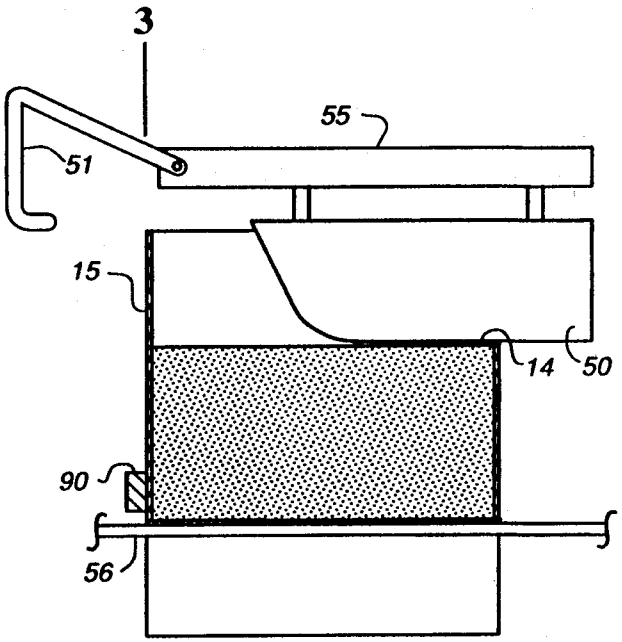
Figure 3G:
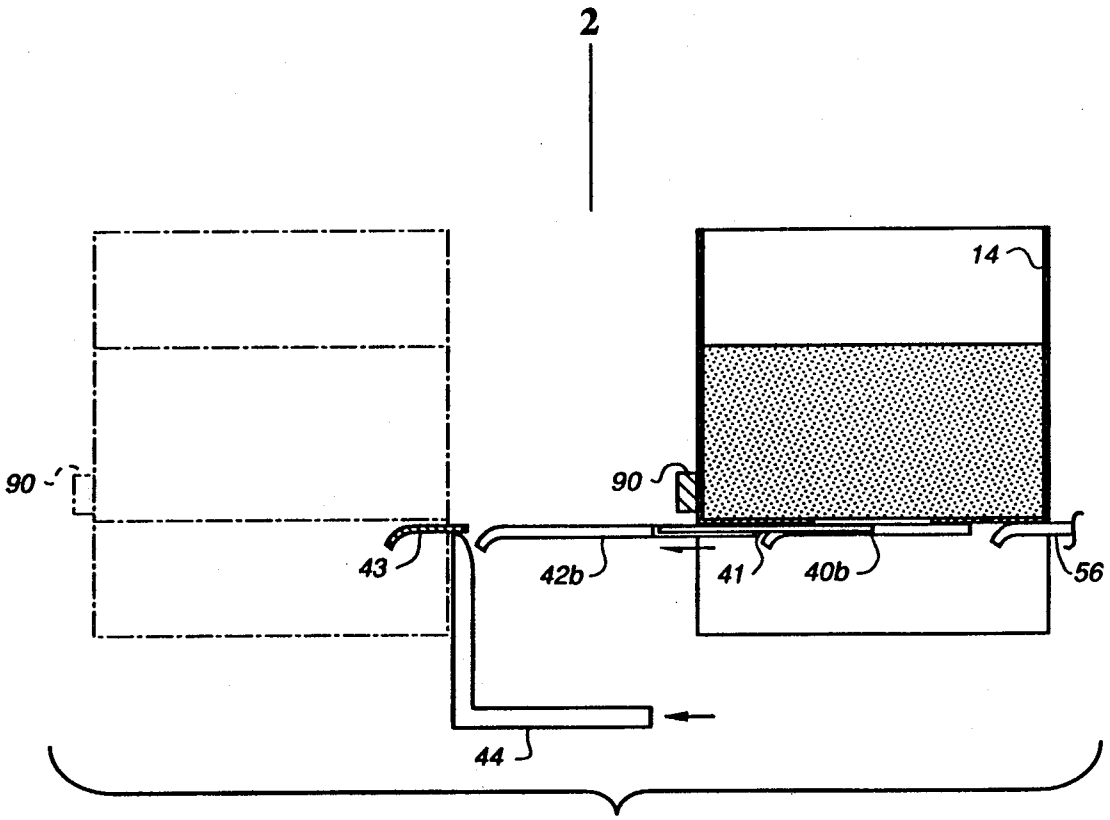
Figure 3J:
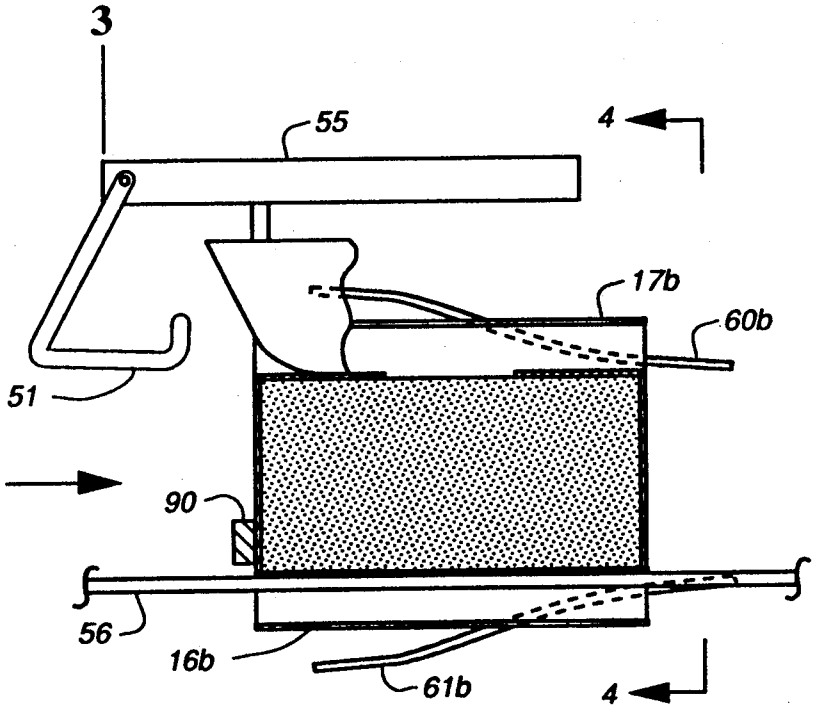
Figure 3I:
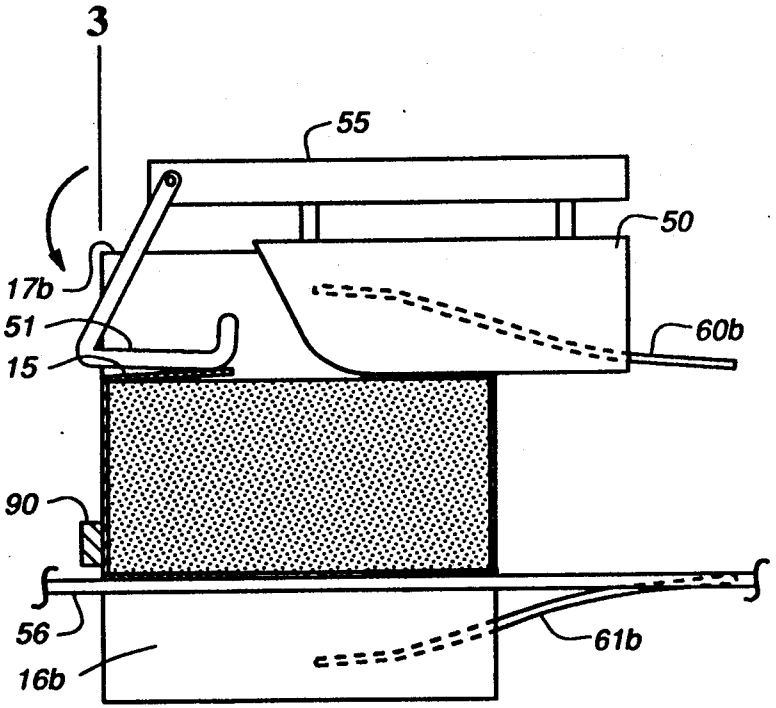

FIGS. 3A–3J show a more detailed cross-sectional side view of the activities described above. The box opening and the loading of the box from the bottom by a loading elevator 30 having a trailing lip 31 into the box at station 1 is shown in cross-section in FIG. 3A. FIG. 3B shows a cross-section of the box fully loaded with the bottom minor trailing flap having been kicked outward by the lip 31 of the elevator 30. FIG. 3C shows a cross-section of the box as it appears after it has arrived at station 2 (the bottom back flap folding station) where both bottom minor flaps 12, 13 are horizontal and oriented in a direction trailing their respective sides (the front flap 12 being in a fully closed position while the trailing minor flap 13 being 180° from its closed position). FIG. 3D shows a cross-section of the folding platform 42 (42*b* shown) dropping (retracting) allowing the trailing bottom minor flap 13 to pivot downwards at its score line. FIG. 3E shows a cross-section of the bottom back folder 44 being retracted, thereby causing the bottom trailing minor flap 13 to be folded towards its fully closed position. FIG. 3F shows a cross-section of the bottom back folder 44 in its fully retracted position and the folding platform 42 (42*b* shown) being partially extended simultaneously with the support tongue 41 being partially retracted. FIG. 3G shows a cross-section of the final position of the operable members (41, 42 (42*b*), 44) at station 2 after the box trailing bottom minor flap 13 has been put in its closed position (i.e. the folding platform 42 is extended, the support tongue 41 and bottom back folder 44 are in a fully retracted position between the fixed supports 40) and the box has already started being indexed to the next station on main slide plate 56 and the box coming to station 2 is shown with phantom lines. FIG. 3H shows the operable members at station 3 where the leading top minor flap plow 50, supported from a depth adjustment support assembly 55 folds the leading top minor flap 14 into a closed position. The trailing top minor flap kicker 51 is in a raised position at the time the box is indexed to station 3 thereby being above the top edge of the trailing top minor flap 15 so that the trailing top minor flap 15 is not folded (touched). Once the box has fully indexed to station 3, the top trailing minor flap kicker 51 drops, as is shown in FIG. 3I, causing the trailing top minor flap to be folded into its closed position. Then as shown in FIG. 3J a very slight forward motion of the box will cause the trailing top minor flap 15 to also be caught by the minor flap plow 50 and to be held closed while the trailing top minor flap kicker 51 rises in preparation to fold the trailing top minor flap of the next box in order. As the box moves from station 3 downstream toward the discharge end of the machine, major flap closing rods 60, 61 (only 60*b* and 61*b* are shown in FIG. 3J) deflect the major flaps 16*a*, 16*b*, 17*a*, 17*b* of the box to their fully closed position, such that when the box reaches the sealing station, the top and bottom major flaps 16*a*, 16*b*, 17*a*, 17*b* of the box will be in a fully closed position so that pressure sensitive tape when it is applied will seal the box.

Figure 4:
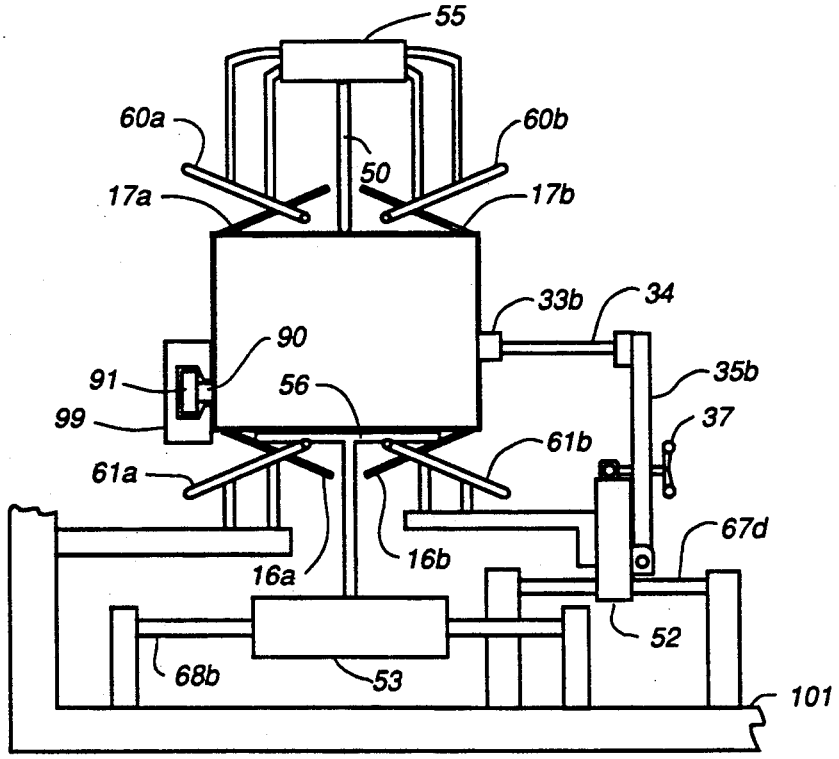
FIG. 4 shows a cross-section of FIG. 3J cut at 4—4.

FIG. 4 shows a full cross-section of FIG. 3J cut at 4—4 The plow 50, the top major flap folding rods 60*a*, 60*b* and the top trailing minor flap kicker 51 (not shown in FIG. 4) are all supported by the depth adjustment support assembly 55 on top of the box. At the bottom of the box the main slide plate 56 across which the center of the box slides after it leaves station 2 is supported by a bottom half width adjustment support assembly 53 which in turn is supported by a series of bottom half width adjustment support shafts 68*a*, 68*b* (only 68*b* is shown). These support shafts 68*a*, 68*b* are supported from the overall frame 101. The bottom half width adjustment support assembly 53 includes linear ball bearings to slide on the bottom half width adjustment support shafts 68 during a width adjustment.

In this embodiment, the bottom major flap folding rod 61*a* is a full width range member and is fixedly supported from the overall frame 101. The outside bottom major flap folding rod 61*b* is movably supported from the full width adjustment support assembly 52. The full width adjustment support assembly 52 is supported by a series of full width adjustment support shafts 67*a, b, c, d* (only 67*d* is shown in FIG. 4). The full width adjustment support assembly 52 is connected to the full width adjustment support shafts 67 by linear ball bearings which permit the full width adjustment support assembly 52 to easily move laterally when adjustment is required. The full width adjustment support shafts 67 are supported from the overall frame 101. The movable side guide rail assembly 33 (33*a*, 33*b*) is pivotably supported by a side guide rail pivotable support assembly 35 (35*a*, 35*b*). This movable side guide rail assembly 33 guides the outside width of the box along its path on the main slide plate 56. At the other side of the box a fixed side guide rail and flite guide 99 enclose a push flite chain 91 which is connected to and drives a push flite 90, behind the box, as shown in FIG. 4.

Figure 6:
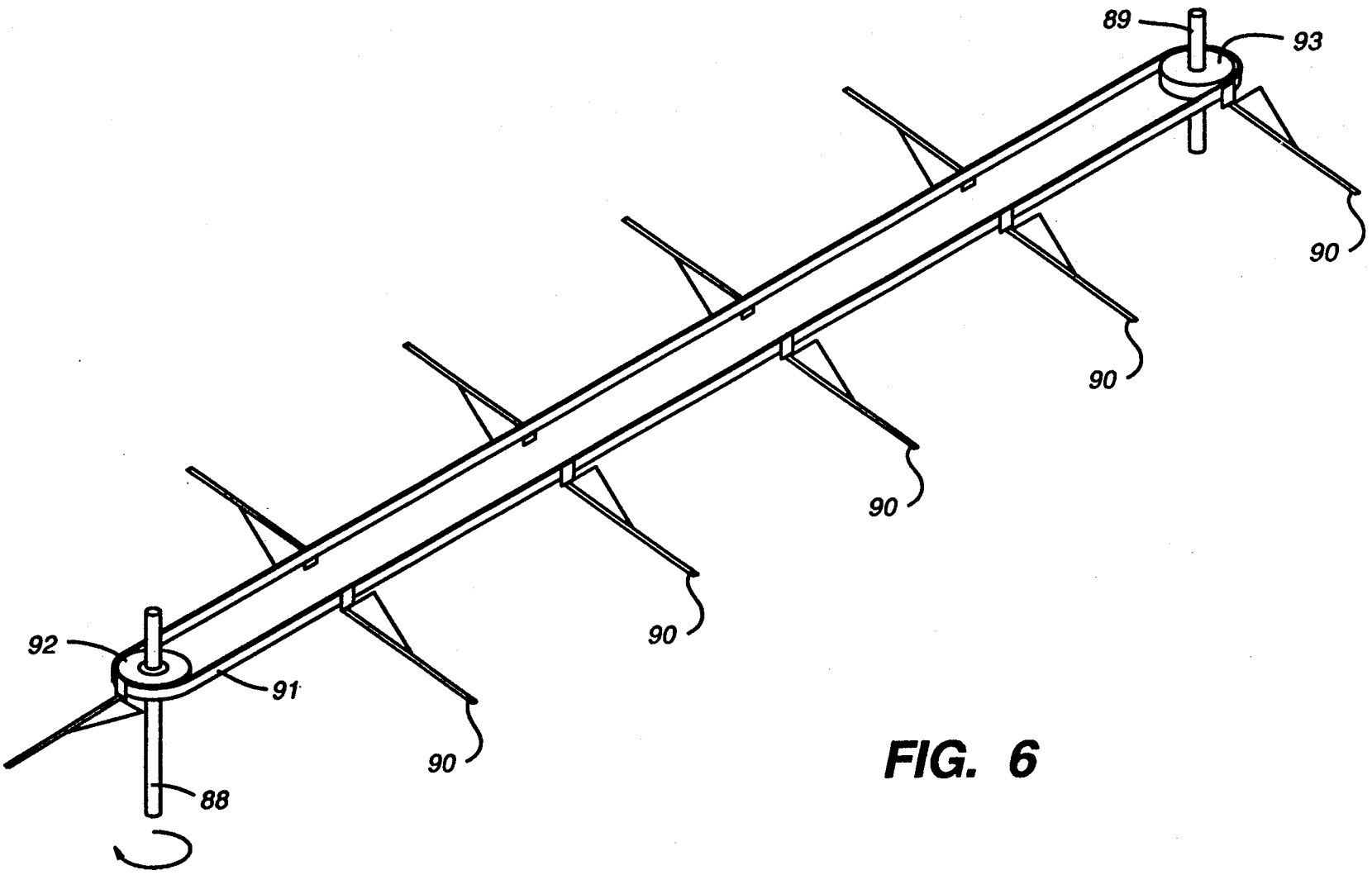
FIG. 6 shows a perspective view of push (drive) flites and drive shaft for the embodiment of FIG. 2.

FIG. 6 shows the drive flites for the embodiment of FIG. 2 where only the push flites 90, having gussets for reinforcement in their pushing direction are mounted on the flite chain 91 which encircles a push flite drive sprocket 92 and a push flite freewheeling sprocket 93. The push flite freewheeling sprocket 93 is mounted on a freewheeling shaft 89 which turns freely as the chain is moved by the push flite drive sprocket 92 which is turned by the drive shaft 88.

Figure 7:
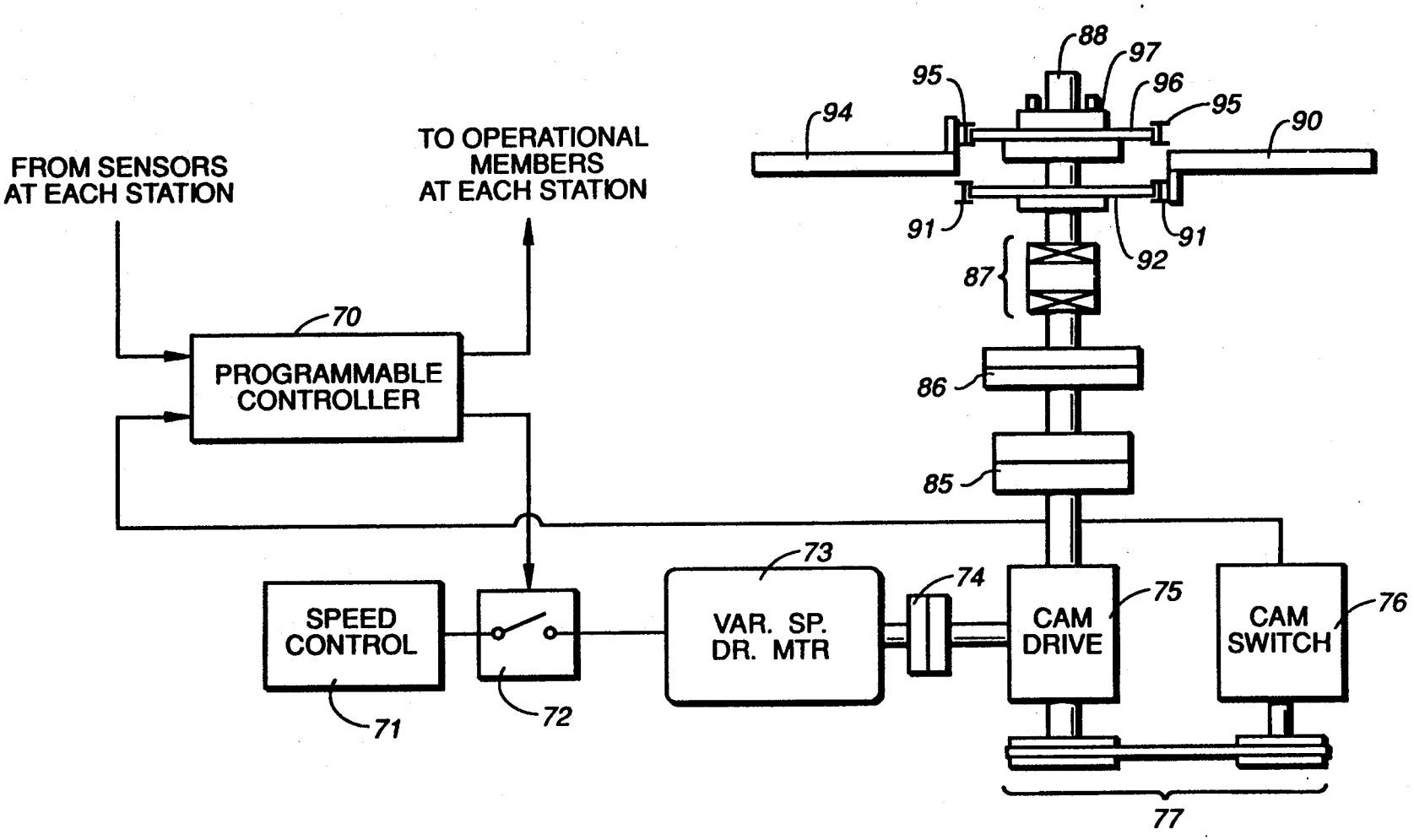
FIG. 7 shows a schematic of a flite drive for the embodiment of FIG. 12, and except for the illustration of "two" sets of flites is also illustrative of the drive of the embodiment of FIG. 2.
Figure 12:
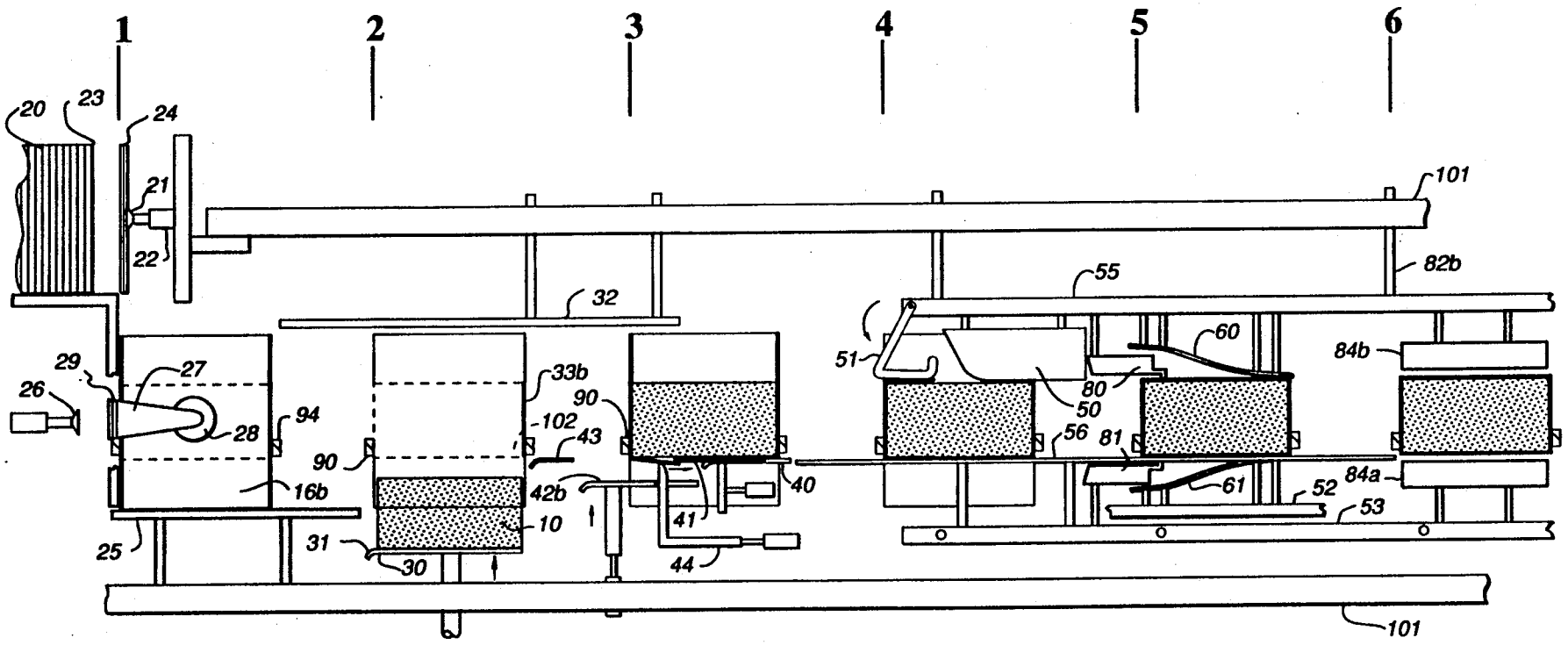
FIG. 12 shows a side view of another embodiment of the invention.

FIG. 7 illustrates the drive for both the embodiment of FIG. 2 and the embodiment as shown in FIG. 12, the only difference being that for the embodiment of FIG. 12 a leading flite assembly including items 94, 95, 96, and 97 are added to the top of the drive shaft 88. The mechanical drive system consists of a variable speed motor 73 driving an indexed drive 75 through a mechanical coupling 74.

Figure 8:
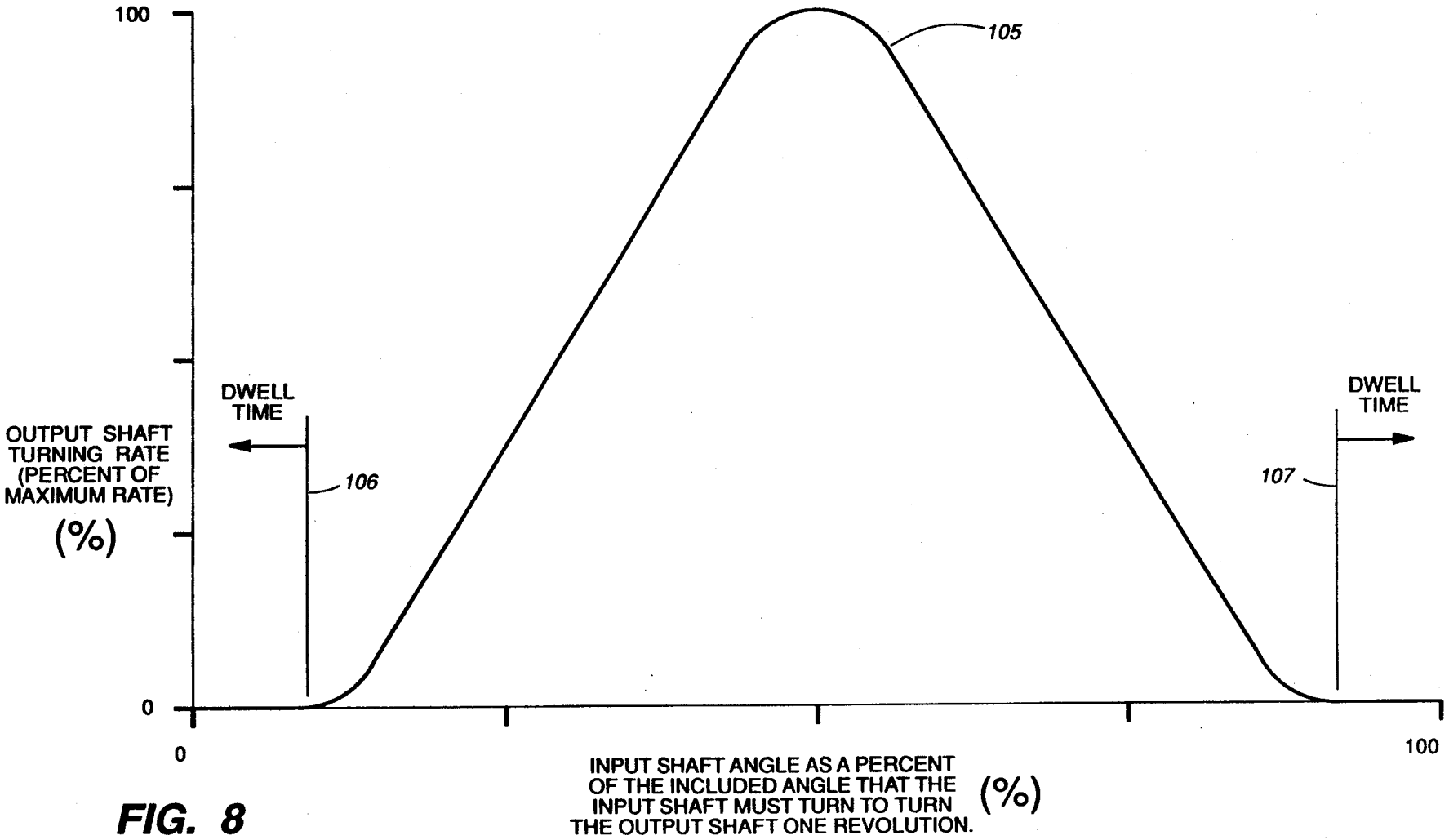
FIG. 8 is a graph showing the correlation of the input shaft angle to output shaft turning rate for a typical index drive of FIG. 7.

FIG. 8 shows the output turning rate of the output shaft of the index drive 75 as a percent of its maximum turning rate versus the index drive's 75 input shaft angle as a percent of the included angle that the input shaft must turn to turn the output shaft one revolution. This shows that during a dwell time the drive shaft 88 is stationary while the input shaft of the index drive is turning. Then the output shaft of the index drive gradually accelerates rapidly to a high rate and then decelerates rapidly until it gradually stops, all while the input shaft is turning at a constant rate. This provides a repeatable precise stopping point at each station while providing an increased transfer speed between stations and a gradual starting and stopping speed just after and before the station position. The rotary cam limit switches 76 are connected to the index drive 75 output shaft by a timing belt and pulley assembly 77 which cause the rotary cam limit switch input shaft to turn precisely one revolution during an indexing step. When an indexing step (cycle) is desired the programmable controller 70 closes a relay switch 72 to energize the variable speed drive motor 73 according to the speed set by a speed controller 71 thereby turning the coupling 74 and the input shaft of the index drive 75. As the input shaft of the index drive turns there is no index drive output shaft motion until a rise in the curve 105 as shown in FIG. 8 occurs at a point beyond a reference line 106. In FIG. 8, the portion of curve 105 between reference lines 107 and 106 is known as dwell (or static) time in the cycle. The relay switch 72 remains closed until a limit switch in a set of limit switches 76 signals the programmable controllers that an index operation has been completed. The signal to the programmable controller 70 signalling that an index cycle is complete is set to operate when the output shaft of the cam drive has reached a position beyond reference line 107 on curve 105.

In this system, the index drive 75 output shaft has already mechanically stopped when the drive motor 73 is stopped and a variation in the electrical stopping of the drive motor will not influence the point at which the flites pushing the box for indexing actually stop. The programmable controller 70 also receives signals from sensors at each station and provide actuation signals to operational members at each station according to its program. The drive shaft 88 is driven from the output shaft of the index drive 75 through an overload clutch 85 which is a detent type clutch which is spring loaded such that an overload torque will cause the clutch to release and the clutch will only re-engage to transmit torque at one specific relationship between the two clutch plates. In this way an overload will not require the readjustment of flites and operational control members, but will automatically reset its prescribed relationship whenever the clutch returns to its torque carrying position. The clutch 85 output drives a timing hub 86 which is used for initial alignment of the drive. The timing hub 86 is capable of aligning its two portions in nearly any angular relationship so that the mechanical components can be aligned to the electrical components during the initial setting step and then the two sides of the timing hub 86 can be locked at practically any point so that this relationship is maintained. A pillow block with two bearings 87 supports the top of the drive shaft 88. On the end of the drive shaft is mounted a push flite drive sprocket 92 which is engaged with a push flite chain 91. The push flite chain 91 supports the push flites 90.

Figure 13:
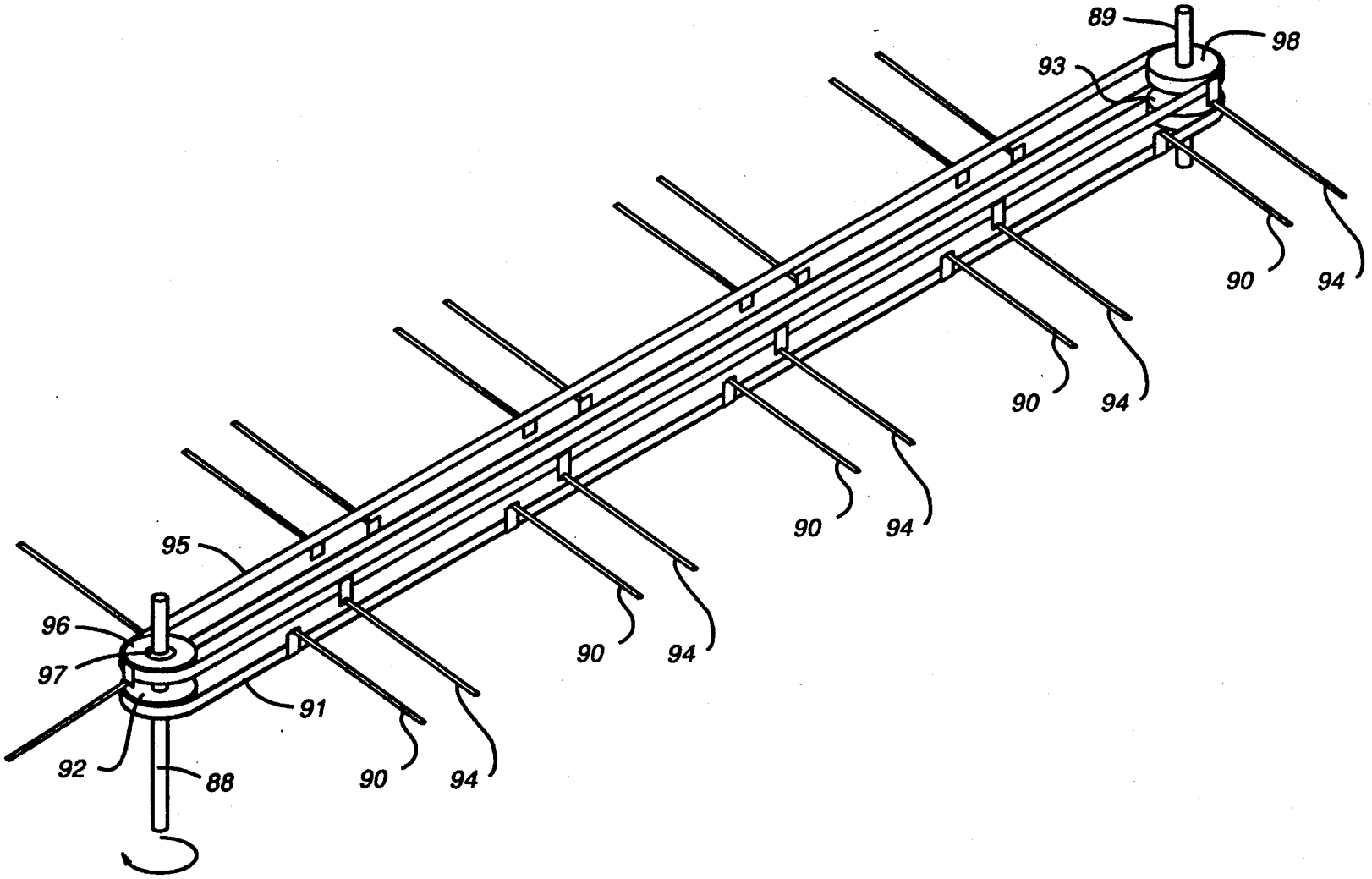
FIG. 13 shows a perspective view of the length adjustment and pushing and leading flites mounted on flexible supports for an embodiment of FIG. 12.

For the embodiment of FIG. 12 a leading flite drive sprocket releasing clutch 97 is mounted on the shaft 88 and supports a leading flite drive sprocket 96 on which is engaged a leading flite chain 95. Leading flites 94 are supported from the leading flite chain 95. When adjustment between the leading flites 94 and the push flites 90 are required the leading flite drive sprocket releasing clutch 97 is released and the leading flite drive sprocket 96 is freely turned relative to the drive shaft 88 and then is re-locked to its new position after adjustment is complete. A perspective view of the drive assembly of FIG. 12 is shown in FIG. 13.

Another embodiment of the present invention is illustrated in FIG. 12. A higher loading speed is possible for this device than the previously described embodiment of FIG. 2 because the box opening operation takes place separately at a first station, while loading of the box takes place at a second station. Increased speed is possible because the loading operation, in this embodiment taking place at the second station, does not have to be delayed until the completion of the box opening operation, which increases the station activity time in the previously described embodiment. The remaining stations in FIG. 12, (i.e. 3, 4, 5, and 6) are similar to those described for the embodiment of FIG. 2, except that glue sealing for the box is provided rather than pressure sensitive tape. The glue is applied from dispensers 80, 81 prior to and/or during the folding of the major flaps 16*a*, 16*b*, 17*a*, 17*b* so that the glue is placed inside the major flap on the uppermost or lowermost surface of the box as these major flaps are folded to their closed position. A compression station having compression members 84*a*, 84*b* is also illustrated. The compression station is required in a glue sealing machine to set the glue for a few seconds during which time the top most and bottom most flaps of the box are pressed toward their closed position by compression members 84*a*, 84*b*.

Processing of boxes with partially or fully overlapping flaps could take place in embodiments similar to those for FIGS. 2 and 12 except that another operational station would be added. With overlapping flaps one side major flap must be folded (which would be done at one station) before the second side major flaps can be folded (at a subsequent station) so that these flaps would not interfere with each other during folding.

All actions at every station are coordinated from the set of rotary cam limit switches 76 during a drive (indexing) movement or from the central programmable controller 70 when there is no drive (indexing) movement. A change in speed is produced when the time of the indexing cycle is increased or reduced by changing the speed of the variable speed drive motor 73 (FIG. 7). The changed motor speed correspondingly adjusts the speed of the box index movement thereby changing the length of the indexing cycle and changing overall throughput speed. A change in speed is performed by increasing the speed of the drive driven by the variable speed motor 73 from a motor speed controller 71 at a central location. When an indexing cycle is initiated the relay switch 72 is closed thereby activating the variable speed drive motor 73 to turn the drive at the pre-set speed.

A set of solid state rotary cam switches 76 (FIG. 7) which are connected to the drive system, coordinate operational activities performed during an indexing cycle according to a set of predetermined indexing positions during each box movement (drive) cycle. Once an indexing movement is complete, one of the set of rotary cam limit switches 76 signals the programmable controller 70 that the cycle is complete which opens the relay switch 72 causing the motor 73 to be stopped. Programmable controller controlled operational activities at all stations then automatically begin. When all of programmable controller controlled operational activities at each station have been completed and verified. The relay switch 72 is again closed and the motor 73 is again started. Each solid state rotary cam limit switch controls operational activities related to a particular drive angle or position and is set accordingly. The rotary cam limit switch is connected to the drive system and the index drive 75 output shaft by a timing belt and pulley assembly 77. Therefore, once the motor 73 is again activated, control functions according to these limit switches 76 provide reliable and repeatable activation of selected operational activities during the drive's movement.

In FIG. 7 the programmable controller 70 sends signals to operational members at each operational station and receives signals from sensors at each station. These output and input signals include but are not limited to the following. Actuations are generally performed by a hydraulic or pneumatic ram separately or in conjunction with vacuum selection valves which connect vacuum cups to a vacuum source when activated. The types of sensors used include bifurcated cable fiber optic sensors, proximity switches, diffuse beam sensors, and fiber optic sensors. At the case magazine 20 a case magazine low diffuse beam sensor indicates that the case magazine should be resupplied as it is nearly empty. Case selection activation causes the magazine index ram, which is connected to a set of metal fingers, securing the end of the case magazine 20 to pivot, placing a flat case against a proximity switch flat case sensor. A case select activation member consisting of a ram 22 connected to a vacuum cup 21 is extended and grabs a case 23 from the case magazine 20. A diffuse beam case selected sensor then determines that a case has been selected. The case is then released by the suction cup 21 and drops through guides onto a case bottom edge stop 25 which has been extended by a ram to be in the falling path of the falling case 23*b*. A bifurcated cable fiber optic sensor senses that the case is down. The set of rear suction cups 26 which are supported by a ram extend and are activated to hold the rear side of the case. The guides which guide the falling of the case from the case magazine 20 are constructed of two vertical beams rectangular bars whose faces are enclosed by pivotable angle irons (case opening gates). When the rear set of suction cups 26 have grabbed the rear side of the case, the case opening gates open the angle irons to release the case from its guide. The case opening pivot arm 27 is then pivoted around its axis 29 so that the front vacuum cup 28 grabs the front side of the case and the pivot arm 27 is pivoted back to open the case. Proximity switches sense the movement of the pivot arm 27. A diffuse beam open case sensor senses that the case is open. The case bottom edge stop 25 is retracted before the product 10 is loaded into the case 23*b* by the elevator 30. The product elevator 30 then elevates the product into position. The full extension of the product elevator 30 is sensed by proximity switches. There are other various sensors and activities which sense product stacking activities as the product is stacked before it is loaded, which may stop the machine during product loading prior to the product reaching station 1.

The activities at station 1 are then complete and movement of the box to station 2 is performed by the means for transferring.

At station 2 the bottom back folding takes place. The bottom back folder 44 and the case support tongue 41 are both actuated (i.e. extended and retracted without the use of proximity sensors). The position of the folding platform 42 is sensed by proximity switches. The activation and sensing (activities) at station 2 are then complete.

At station 3 the top back folder (kicker) 51 is activated without any sensing device. The activities at station 3 are then complete.

At station 4, which completes the folding of the box's major flaps, tape reel sensors which are diffuse beam sensors sense a nearly empty reel. Diffuse beam sensors sense the case entering into the taping section and leaving from the taping section.

On the drive for the transfer means of machine there is a proximity switch which is an indexer overload sensor sensing the release of the overload clutch 85.

All of the above-mentioned sensing and activation is connected to the programmable controller 70 as illustrated in FIG. 7.

The rotary cam limit switches 76 which are activated in connection with the turning of the drive shaft driving the transfer means by the timing belt and pulley assembly 77 perform the following functions during the box transfer indexing time. They send a signal to the programmable controller that the indexer is at its dwell position. At a second position switch causes the product elevator 30 to be moved to its down position. A third position switch causes the flat case to drop. A fourth position switch causes the case open gates on the drop guide to close. A fifth position switch causes the case to open. A sixth position switch causes the bottom back folder 44 and top back folder 51 to extend to their extended positions. Another position switch resets the case bottom edge stop (flat case down platform) 25.

The sensors and activations for an embodiment as shown in FIG. 12 are very similar to the sensors and activities as shown in the embodiment of FIG. 2. The difference between these two embodiments are discussed as follows. In FIG. 2 the flat case is dropped, opened, and loaded at a first station while in FIG. 12 the flat case is dropped opened and then moved to a second station before it is loaded. Therefore, an embodiment according to FIG. 12 does not have a movable case bottom edge stop 25. The bottom edge stop in FIG. 12 is fixed and not activated. The flat case down sensor for the embodiment of FIG. 12 is a diffuse beam sensor. Also, the open case sensor for the embodiment of FIG. 12 is a bifurcated cable fiber optic sensor. Further, at station 2 of FIG. 12 there is a diffuse beam "case in place" sensor which senses that the case has reached station 2. At station 3, the back flap folding station, both the bottom back flap and the top back flaps are simultaneously folded. The embodiment of FIG. 12 shows glue sealing and therefore there is a top glue and a bottom glue activation according to a diffuse beam fluid interlock sensor. The glue application can be varied according to the programmable controller for higher speeds and different size boxes so that the amount of glue applied is sufficient to perform its required function. At station 5, the compression station, a bottom compression unit and a top compression unit are energized. The embodiment of FIG. 12 has leading flites to square up the box but these do not have any impact on the sensing done. All other sensors are similar to those described for the embodiment of FIG. 2.

When it is desired to change the speed of the drive all operational activities are coordinated according to the rotary cam switches 76. The programmable controller 70 coordinates (activates and senses) the operational activity at each of the operational stations and coordinates the beginning and ending of operational activities at each station with the ending and beginning of an indexing cycle.

Figure 9:
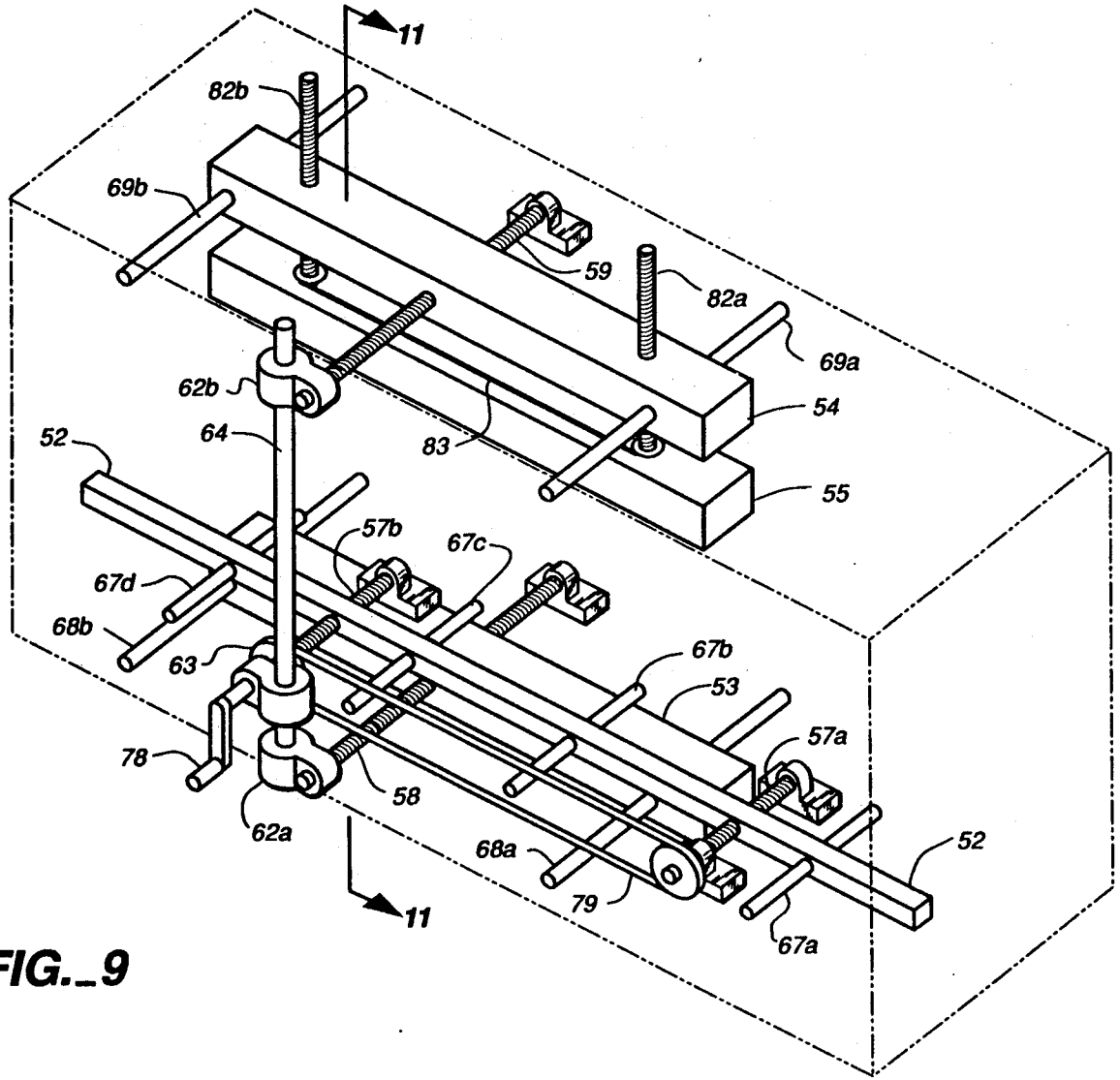
FIG. 9 shows a perspective view of full and half width adjustment members and the depth adjustment member and their support and adjusting mechanism for the embodiments shown in FIGS. 2 and 12.

An advantage of the in-line devices as described in the above embodiments is the ability to quickly and easily adjust the machines to accommodate a change in the size of the box being loaded. FIG. 9 shows a perspective view of the various adjustable pieces of the machines of either of the two embodiments. A movable side guide support assembly 52 supports a common side guide rail 33*a*, 33*b* (FIG. 10) as boxes move from the feed end to the discharge end of the machine. When moving from the feed end to the discharge end all boxes keep one side in contact with the fixed side guide rail and flite guide 99 and are carried across the bottom score line plane 100.

When a width adjustment is necessary the movable side guide rail 33*a*, 33*b* and its support assembly 52 are supported and move in unison with the full width adjustment support assembly 52.

The support assembly 52 is supported on four full width adjustment supports shafts 67*a*, 67*b*, 67*c*, 67*d* which are preferably two-inch diameter hardened steel shafts supported on the full width adjustment support assembly 52 by linear ball bearing assemblies (not shown) at each shaft to permit easy movement of the support assembly. The position of the full width adjustment support assembly 52 is controlled and adjustable by a set of full width adjustment threaded rods 57*a*, 57*b*. These rods having an Acme thread engage complementary threaded holes in the full width adjustment support assembly 52 such taht when the full width adjustment threaded rods 57*a*, 57*b* are turned the full width adjustment support assembly 52 moves parallel to the longitudinal axis of the machine and keeps the full width adjustment support assembly 52 parallel to the fixed side guide rail and flite guide 99 along which the boxes in the machine slide. The two full width adjustment threaded rods 57*a*, 57*b* are connected by a full width threaded rod sprocket and chain connecting assembly 79 which causes the threaded rods 57*a*, 57*b* to turn in unison. If the machine was longer, additional full width adjustment threaded rods would be provided and tied together to assure that the movable side guide rail and its full width adjustment support assembly 52 maintain their parallel relationship with the fixed reference side and longitudinal axis of the machine.

Turning of the full width adjustment threaded rod 57*b* is accomplished by a crank arm and handle 78 at the end of the rod 57*b*. Part of the threaded rod 57*b* and/or the shaft of the crank arm and handle 78 engage a 2:1 90° gear box 63. This 2:1 90° gear box 63 engages a vertical half width adjustment threaded rod connecting shaft 64 such that when the full width adjustment threaded rods 57 are turned the half width adjustment threaded rod connecting shaft 64 turns at half the rate that the full width adjustment threaded rods 57 turn.

It is also necessary to provide for adjustment of structural and operational members which must maintain a prescribed relationship with the centerline of a box being loaded. All half width adjustment members along the bottom of the box are supported by a bottom half width adjustment support assembly 53. This assembly 53 supports the main slide plate 56 and the taping or gluing units in the machine. The bottom half width adjustment support assembly 53 as shown in FIG. 9 is supported by two crosswise bottom half width adjustment support shafts 68*a*, 68*b* which are hardened steel shafts fixed to the frame 101. The bottom half width adjustment support assembly 53 has linear guide ball bearings which ride on the bottom half width adjustment support shaft 68 to provide a smooth lateral motion when moved along these support shafts 68 which are mounted in parallel. A bottom half width adjustment threaded rod 58 (preferably having Acme threads) is engaged with a thread receiving hole on the bottom half width adjustment assembly 53 such that when the threaded rod 58 is turned the bottom half width adjustment support assembly 53 moves parallel to the longitudinal axis of the machine and maintains its position relative to the width centerline of the box being processed, as required for adjustment. The bottom half width adjustment threaded rod 58 is connected by a bottom 1:-1 90° gear box 62*a* to the bottom of the half width adjustment threaded rod connected shaft 64 such that when the half width adjustment threaded rod connecting shaft 64 is turned, at half the rate of the full width adjustment threaded rods 57, the bottom half width adjustment threaded rod 58 also turns at half the rate of the full width adjustment threaded rods 57. Since both of these sets of threaded rods 57, 58 have the same thread pitch, the bottom half width adjustment support assembly 53 moves at half of the rate that the full width adjustment support assembly moves when an adjustment is performed.

Similarly, a top half width adjustment support assembly 54 performs a function similar to the bottom half width adjustment support assembly 53 except above the box path in the machine. The top half width adjustment support assembly 54 is supported by top half width adjustment support shafts 69*a*, 69*b* engaging linear ball bearings receiving those shafts 69 in the support assembly 54. The top half width adjustment threaded rod 59 is engaged in a threaded hole in the support assembly 54 to move the top support assembly 54 simultaneously with the bottom support assembly 53. The top half width adjustment threaded rod 59 is connected to the half width adjustment threaded rod connecting shaft 64 by a top 1:1 90° gear box 62*b* which functions identically with the bottom 1:1 90° gear box 62*a*, previously described.

The top half width adjustment support assembly 54 is connected to a depth adjustment support assembly 55 by depth adjustment threaded rods 82*a*, 82*b* which engage threaded holes in the top half width adjustment support assembly 54 but are fixed to rotatable bearings (not shown) in the depth adjustment support assembly 55. Depth adjustment threaded rods 82*a*, 82*b* are connected together and turn simultaneously by a depth adjustment threaded rod sprocket and chain connecting assembly 83. A fixed nut is provided at the top of either threaded rod 82*a* or 82*b*, such that when this nut (not shown) is rotated both threaded rods rotate simultaneously to move the depth adjustment support assembly 55 up and down in the machine while maintaining parallelism with the bottom score line plane 100 of the machine along which the bottom of the boxes move. Connected to and supported by the depth adjustment support assembly 55 are the top trailing minor flap kicker (top back folder) 51, plow 50, both top major flap folding rods 60*a*, 60*b*, and the tape or gluing or sealing sections.

The machine adjustments to accommodate a new box length are sometimes necessary. For the embodiment of FIG. 2, described above, no adjustment is necessary. One push flite 90 corresponds to each station. These flites 90 are provided at evenly spaced distances along movable support to accommodate a box of any length within the range of lengths of the machine, so that as the box is pushed from behind the product inside the box prevents the box from collapsing. This is because the opening of a flat box and loading of the product occur at a first station while the box is held open by suction cups and the product once it is loaded into the box maintains the shape of the box so that there is no danger of the box collapsing while it is being pushed from behind by a single push flite.

The length adjustment for the embodiment described in FIG. 12 above requires that the box once opened at a first station (1) remain in this open position while it is empty and is moved to a second station (2) where the product loading takes place. A fixed side guide rail and flite guide 99 is located along one side of the box while the movable side guide rail 33*a*, 33*b*, which is adjustable, is located along the other side of the box and a rear/push flite 90 provides the motive force to move the empty box forward. In addition, a forward leading flite 94 is provided, as is illustrated in FIG. 13, to contact the leading side of the box to hold it in its already open position during its movement between station 1 and station 2 and its movements between subsequent stations. The product 10 loaded into the box at station 2 will also assist the leading flite 94 in holding the box open at stations after the product has been loaded.

The flite mechanism of the embodiment of FIG. 12 is shown in FIG. 13. The upper right hand portion of FIG. 13 shows freewheeling pullies 93, 98 supported by a free wheeling shaft 89 while the shaft illustrated at the lower left hand corner is the drive shaft 88. Mounted on the drive shaft 88 is a push flite drive sprocket 92 and a leading flite drive sprocket 96 gear attached to the drive shaft 88 by a leading flite drive sprocket releasinq clutch 97. One chain (preferably a roller type) is engaged with each drive sprocket 92, 96 and its respective free wheeling sprocket 93, 98. The chains 91, 95 can move relative to one another when the clutch 97 is released. For example, when it is necessary to change the length of the box size accommodated by the in-line loading machine according to the embodiment of FIG. 12, the releasing clutch 97 is released and the leading flite drive sprocket 96 is manually turned pulling the upper leading flite support chain 95 along to move the front flites 94 (which are attached to the upper roller chain 95 at spaces equal to the spaces between the rear flites 90 on the lower chain 91), such that there is equal spacing between the leading 94 and pushing flites 90. Once the correct predetermined dimension has been set, the releasing clutch 97 is locked to the drive shaft 88 and any further rotation will cause both the drive sprockets 92, 96 and the drive shaft 88 to move thereby causing both sets of flite chains (supports) 91, 95 to move simultaneously while maintaining a predetermined fixed dimension between the leading 94 and pushing flites 90.

Some size adjustments require manual unclamping, alignment, and clamping of pieces, those are: the case bottom edge stop plate 25 (below the case magazine, aligned so that the bottom edge of the bottom flaps are properly oriented so that the box bottom score line coincides with the bottom score line plane 100 of the machine (FIGS. 2 and 12) and a case capture guide 32 (FIGS. 2 and 12) provided along the top edge of the top flaps (to prevent the box from rising away from its bottom score line) reference plane as it is loaded and moved.

Some parts must be changed over when the box size is changed. These change over parts include the product elevator plate 30 and the "curved plate after loading" 43.

The machine is preferably constructed of stainless steel.

The support tongue 41 can also be supported from the bottom half width adjustment support assembly 53. While the outside fixed support 40*b* can be supported by the full width adjustment support assembly 52.

Figure 10:
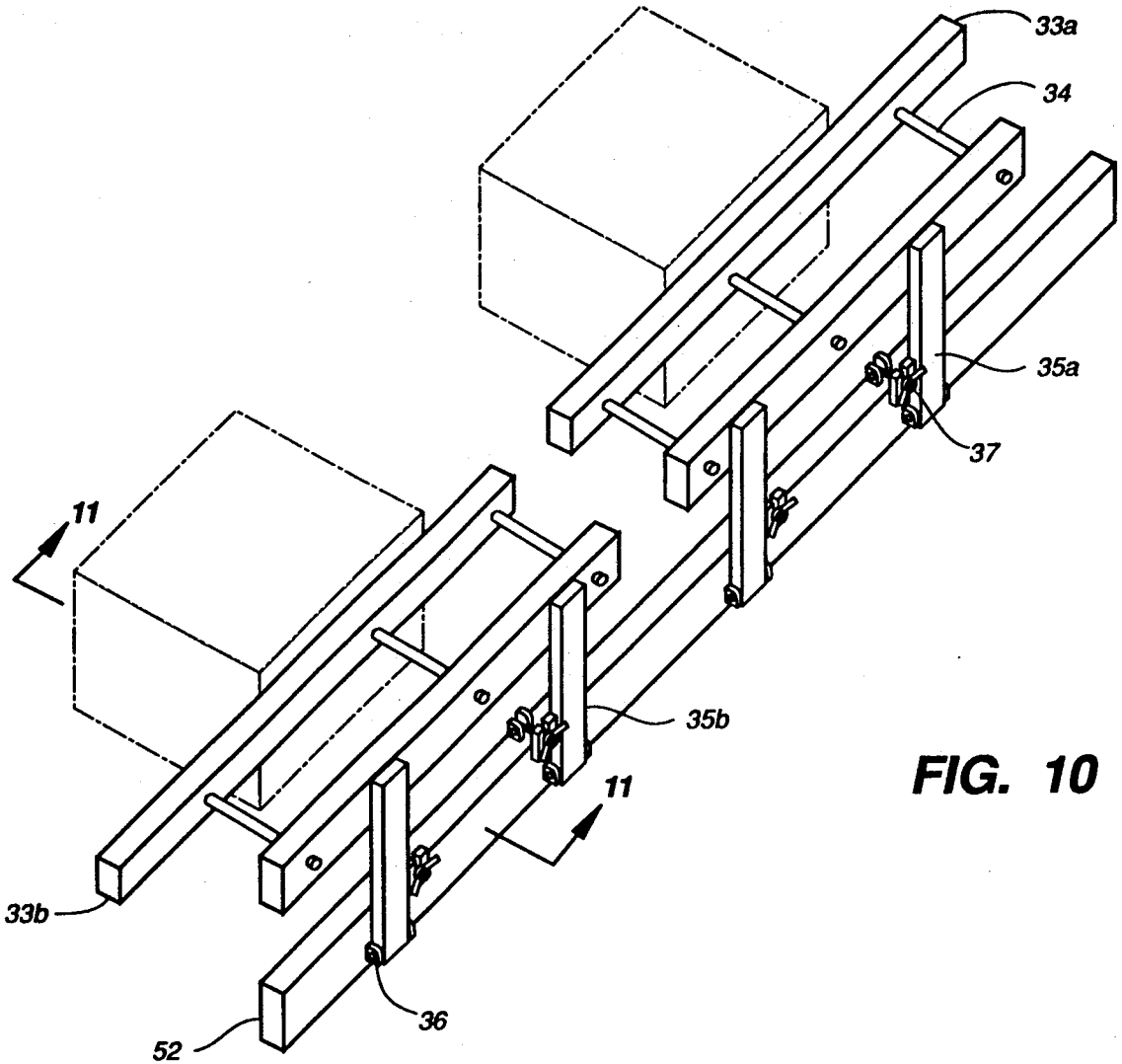
FIG. 10 is a perspective view of the movable side guide rail assembly and its support assembly for the embodiments shown in FIGS. 2 and 12.

FIG. 10 shows a perspective of the full width adjustment support assembly 52 supporting the movable side guide rails 33*a*, 33*b*. The fixed but rotatable half width adjustment threaded rod connecting shaft 54 (FIG. 9) connects the top and bottom of the machine making it necessary to leave an open space between the feed and movable side guide rail 33*a*and the discharge end movable side guide rail 33*b*. When these movable side guide rails 33*a*, 33*b* need to be pivoted out of the way for maintenance or operational access they will not interfere with the half-width adjustment threaded rod connecting shaft 64, which is disposed in the space between their pivot motions. The discharge movable side guide rail 33*b* is connected by several side guide rail initial adjustment rods 34 to a discharge side guide rail pivotable support assembly 35*b*. The discharge side guide rail pivotable support assembly 35*b* is supported and pivots and pivots around a side guide rail pivot support 36. The side guide rail pivotable support assembly includes a yoke opening through which a side guide rail pivotable support assembly pivotable clamp with handle 37 is provided at each vertical member and extends at each vertical member to clamp the side guide rail pivotable support assembly 35*b* in its vertical position and fixed to the full width adjustment support assembly 52.

Figure 11:
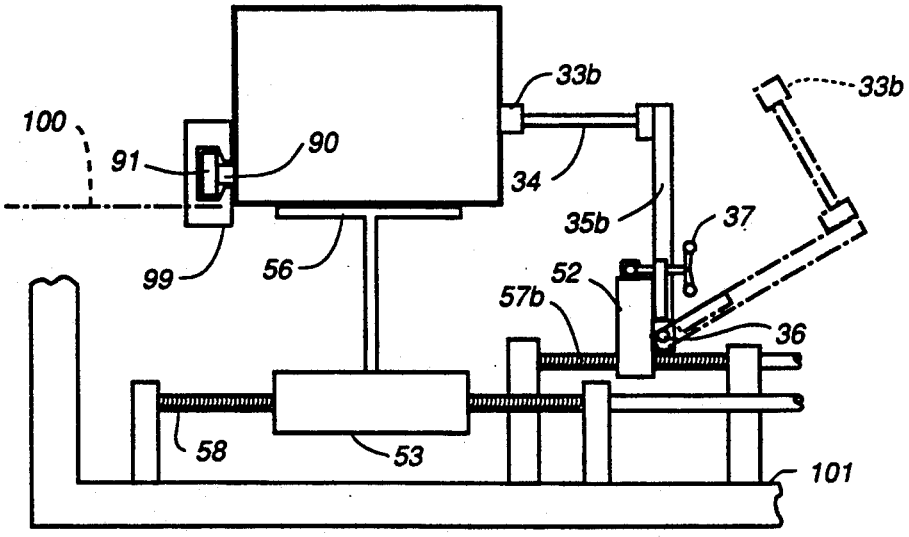
FIG. 11 shows a typical end view of the lower full and half width adjustment means according to cross-sections 11—11 cut in FIGS. 9 and 10.

FIG. 11 shows an end view (sections 11—11 cut in FIGS. 9 and 10) of either one of the embodiments as described above showing the bottom score line reference plane 100 and the fixed side guide (reference) rail and flite guide 99 opposite the movable side guide rails 33*a*, 33*b*. A pivot point/axis 36 of the side rail is shown along with its attachment such that the side rail assembly 33 can be easily released and moved out of the access path for servicing or clearing a jam when it occurs in the operation of the loading machine.

While the invention has been described with regards to specific embodiments, those skilled in the art will recognize that changes can be made in form and detail without departing from the spirit and scope of the invention.

What is claimed is:

1. A structure comprising:

a frame having a feed end and a discharge end, wherein a longitudinal axis of said frame extends between said feed end and said discharge end, said frame including a plurality of stations along said axis;

means for transferring a carton having a centerline from said feed end to said discharge end generally along said axis while holding said centerline of said carton generally parallel to said longitudinal axis, wherein said means for transferring includes a means for providing an indexing cycle such that at a beginning of said indexing cycle said carton is stationary at a first of a set of any two adjacent stations of said plurality of stations along said axis and at an end of said indexing cycle said carton is stationary at a second of said set of any two adjacent stations, wherein the carton includes a set of bottom flaps on a bottom end of the carton;

means for holding the carton in an open upright position at a first position along said axis;

means for loading a product into the carton at a second position along said axis; and means for moving the set of bottom flaps on the carton from an open position when the carton is at said first position along said axis between said feed end and said discharge end to a closed position when said carton is at said discharge end, said means for moving being disposed along said axis.

2. A structure as in claim 1, wherein said means for transferring includes a first continuous flexible support to which evenly spaced are attached a set of push flites which engage the carton.

3. A structure as in claim 2, wherein said means for transferring further includes a second continuous flexible support to which evenly spaced are attached a set of leading flites which engage the carton.

4. A structure as in claim 3, wherein said first continuous flexible support and said second continuous flexible support are routed along a generally parallel path around a drive shaft, said first flexible support means engaging said drive shaft through a first means for engagement, said second flexible support means engaging said drive shaft through a second means for engagement such that in an operational mode said first means for engagement and said second means for engagement both fixedly engage said drive shaft and when in an adjustment mode said second means for enagagement is rotatable engaged with said drive shaft such that said second continuous support can be moved relative to said first continuous support along said parallel path.

5. The structure as in claim 1, wherein said frame comprises:

a guide rail, a movable side rail, and a width adjustment means, wherein both of said rails are generally parallel to said axis of said frame and each other and the carton is guided from said feed end to said discharge end of said frame between said rails, and wherein a full width distance between said guide rail and said side rail is adjustable by said width adjustment means.

6. The structure as in claim 5, wherein said movable side rail is attached to a full width adjustable frame portion and said width adjustment means when adjusted causes said full width adjustment frame portion to move, changing said full width distance between a fixed guide rail and said movable side rail such that at any point during said adjustment said movable side rail is generally parallel to said axis.

7. The structure as in claim 6, wherein said adjustment means includes at least one full width adjustment threaded rod disposed generally perpendicular to said axis such that a thread receiving portion on said full width adjustable portion of said frame engages said full width adjustment threaded rod and moves said full width adjustable portion of said frame along said rod at a first rate relative to said rod as said rod is turned about a longitudinal axis of said rod.

8. The structure as in claim 1, wherein said frame comprises a guide rail and a center guide portion having a central axis wherein said guide rail and said central axis are generally parallel to said longitudinal axis and a width adjustment means, wherein a half width distance between said guide rail and said central axis of said center guide portion is adjustable by said width adjustment means.

9. The structure as in claim 8, wherein said center guide portion is attached to a half width adjustment frame portion to move, such that said half width distance changes when said adjustment means moves said half width adjustment frame portion which maintains a generally parallel altitude with said guide rail as the half width adjustment frame portion moves.

10. The structure as in claim 9, wherein said adjustment means includes at least one threaded rod generally perpendicular to said longitudinal axis such that a thread receiving portion on said center guide portion of said frame engages said threaded rod and moves said center guide portion of said frame along said rod at a first rate relative to said rod as said rod is turned.

11. The structure as in claim 7, wherein said frame comprises a guide rail and a center guide portion having a central axis wherein said guide rail and said central axis are generally parallel to said longitudinal axis and a width adjustment means, wherein a half width distance between said guide rail and said central axis of said center guide portion is adjustable by said width adjustment means, wherein said center guide portion is attached to a half width adjustment frame portion to move such that said half width distance changes when said adjustment means is adjusted and as said half width adjustment frame portion moves it maintains a generally parallel attitude with said guide rail, wherein said adjustment means includes at least one half width adjustment threaded rod generally perpendicular to said longitudinal axis such that a thread receiving portion on said center guide portion of said frame engages said half width adjustment threaded rod and moves said center guide portion of said frame along said rod at a first rate relative to said rod as said rod is turned, wherein a rod turning means is provided for turning said half width adjustment threaded rod and said full rate adjustment threaded rod simultaneously such that said half width adjustment threaded rod is turned at approximately one-half the rate of said full width adjustment threaded rod.

12. The structure as in claim 11, wherein said rod turning means includes a crank connected to a first sprocket around which a roller-type chain is routed which turns a second sprocket connected to a second full width adjustment threaded rod at a predetermined distance from said first sprocket such that said first and second sprockets turn at the same rate when turned.

13. The structure as in claim 1, where said frame includes an upper frame portion which is disposed generally parallel to a bottom score line plane of said frame, such that said upper frame portion is movable relative to said bottom score line plane while maintaining a central plane of said upper frame portion generally parallel to said bottom score line plane of said frame.

14. A structure according to claim 1 wherein said means for transferring includes a flite drive which includes an index drive having an input shaft and an output shaft having a dwell time, in its output shaft as the input shaft is turned, during which a motor driving the input shaft is stopped.

15. A structure according to claim 1, further comprising a cam switch means for coordinating a set of coordinated activities take place during operation of said means for transferring according to a predetermined relationship with a drive shaft of said means for transferring.

16. A structure according to claim 15, further comprising a speed adjustment means to change a speed of said drive shaft can be changed to correspondingly change a duration of operation of said means for transferring.

17. A structure as in claim 1 wherein said means for moving the set of bottom flaps includes a bottom trailing minor flap closing mechanism having a support tongue, a folding platform, and a bottom back folder, which interact to close a bottom trailing minor flap of the carton.

18. A structure as in claim 17, wherein said support tongue supports a rear end of the box while said folding platform is moved out of a folding path of a bottom trailing minor flap of the box, said bottom back folder folds said bottom trailing minor flap through the folding path to a closed position in contact with said support tongue after said folding platform is outside the folding path, after the bottom trailing minor flap has reached the closed position said folding platform is moved into contact with the bottom trailing minor flap and said support tongue is moved to a second position where said support tongue is not in contact with the bottom trailing minor flap of the carton.

19. A structure as in claim 5, wherein said movable side rail comprises a pivotable movable side guide rail which when in an operational position captures a width dimension of a carton being processed by said structure and when in a maintenance position is disposed outside an access path obstructed by said pivotable movable side guide rail when in the operational position.

20. A structure as in claim 19 wherein said pivotable movable side guide rail is held in the operational position by a releasable clamp.

21. A method comprising the steps of:

placing a carton having major and minor bottom flaps on a bottom end thereof in an upright position with the bottom flaps of the carton in an open position at a first position;

loading a product into the carton through its bottom end, said carton being held stationary at a second position;

folding a bottom forward minor flap of said flaps closed as the carton is moved to a third position where said carton is held stationary;

folding a bottom trailing minor flap of said flaps closed at said third position wherein said first, said second, and said third positions are consecutive along an axis.

22. A method as in claim 21, wherein the step of folding said bottom trailing minor flap includes supporting a trailing portion of said carton with a support tongue while a folding platform is moved out of a bottom trailing minor flap folding path and a bottom back folder moves said bottom trailing minor flap along said folding path to a closed position.

23. A structure comprising:

a frame having a feed end and a discharge end, wherein a longitudinal axis of said frame extends between said feed end and said discharge end, said frame including a plurality of stations along said axis;

means for transferring a carton having a centerline from said feed end to said discharge end generally along said axis while holding said centerline of said carton generally parallel to said longitudinal axis, wherein said means for transferring includes a means for providing an indexing cycle such that at a beginning of said indexing cycle said carton is stationary at a first of a set of any two adjacent stations of said plurality of stations along said axis and at an end of said indexing cycle said carton is stationary at a second of said set of any two adjacent stations, wherein the carton includes a set of bottom flaps on a bottom end of the carton;

means for holding the carton in an open upright position at a first position along said axis;

means for loading a product into the carton at said first position along said axis; and means for moving the set of bottom flaps on the carton from an open position when the carton is at said first position along said axis between said feed end and said discharge end to a closed position when said carton is at said discharge end, said means for moving being disposed along said axis.

24. A method comprising the steps of:

placing a carton having major and minor bottom flaps on a bottom end thereof in an upright position with the bottom flaps of the carton in an open position at a first position;

loading a product into the carton through its bottom end, said carton being held stationary at said first position;

folding a bottom forward minor flap of said flaps closed as the carton is moved to a second position where said carton is held stationary;

folding a bottom trailing minor flap of said flaps closed at said second position wherein said first and said second positions are consecutive along an axis.

25. A method as in claim 24, wherein the step of folding said bottom trailing minor flap includes supporting a trailing portion of said carton with a support tongue while a folding platform is moved out of a bottom trailing minor flap folding path and a bottom back folder moves said bottom trailing minor flap along said folding path to a closed position.

* * * * *